US011473863B2

(12) United States Patent
Knöpfle

(10) Patent No.: US 11,473,863 B2
(45) Date of Patent: Oct. 18, 2022

(54) RECEIVERS FOR SELF-LOADING FIREARMS AND SELF-LOADING FIREARMS EQUIPPED WITH RECEIVERS

(71) Applicant: HECKLER & KOCH GmbH, Oberndorf (DE)

(72) Inventor: Rolf Knöpfle, Alpirsbach-Peterzell (DE)

(73) Assignee: HECKLER & KOCH GmbH, Oberndorf (DE)

( * ) Notice: Subject to any disclaimer, the term of this patent is extended or adjusted under 35 U.S.C. 154(b) by 0 days.

(21) Appl. No.: 17/463,151

(22) Filed: Aug. 31, 2021

(65) Prior Publication Data

US 2022/0170708 A1 Jun. 2, 2022

(30) Foreign Application Priority Data

Sep. 2, 2020 (DE) ..... 10 2020 122 930.5

(51) Int. Cl.

| | |
|---|---|
| ***F41A 3/72*** | (2006.01) |
| ***F41A 3/66*** | (2006.01) |
| ***F41A 17/42*** | (2006.01) |
| ***F41A 35/06*** | (2006.01) |

(52) U.S. Cl.

CPC ..... *F41A 3/72* (2013.01); *F41A 3/66* (2013.01); *F41A 17/42* (2013.01); *F41A 35/06* (2013.01)

(58) Field of Classification Search

CPC .... F41A 3/72; F41A 35/06; F41A 3/66; F41C 7/06

USPC ..... 89/1.4

See application file for complete search history.

(56) References Cited

U.S. PATENT DOCUMENTS

| | | | |
|---|---|---|---|
| 3,255,667 | A | 6/1966 | Walther |
| 3,686,998 | A | 8/1972 | Seifried |
| 4,702,144 | A | 10/1987 | Zedrosser |
| 5,214,233 | A | 5/1993 | Weldle et al. |
| 6,508,158 | B2 | 1/2003 | Murello |
| 7,219,463 | B2 | 5/2007 | Wössner |

(Continued)

FOREIGN PATENT DOCUMENTS

| | | |
|---|---|---|
| DE | 1 208 221 | 12/1965 |
| DE | 199 03 321 | 8/2000 |

(Continued)

OTHER PUBLICATIONS

German Patent Office, "Office Action", issued in connection with German Patent Application No. 10 2020 122 930.5, dated Apr. 13, 2021, with English Translation, 24 pages.

(Continued)

*Primary Examiner* — Reginald S Tillman, Jr.
(74) *Attorney, Agent, or Firm* — Hanley, Flight & Zimmerman, LLC

(57) ABSTRACT

This disclosure relates to weapon receivers, profile rails, and weapons. According to one example, a receiver for a self-loading firearm, includes a first guide track within which a loading lever can be moved to move a loading tube that can be brought into contact with, or is in contact with a breech-block; a second guide track connected to the first guide track, wherein the loading lever can be shifted to the second guide track via a first opening in the receiver to move the loading tube, such that the loading lever can be operated ambidextrously. Other examples are contemplated.

39 Claims, 20 Drawing Sheets

(56) References Cited

U.S. PATENT DOCUMENTS

| | | | |
|---|---|---|---|
| 7,798,045 | B1 | 9/2010 | Fitzpatrick et al. |
| 8,156,854 | B2 | 4/2012 | Brown |
| 8,307,747 | B2 | 11/2012 | Fitzpatrick et al. |
| 8,539,871 | B1 | 9/2013 | Burt et al. |
| 8,561,517 | B2 | 10/2013 | Brown |
| 9,109,848 | B2 | 8/2015 | Brown |
| 2002/0004664 | A1 | 1/2002 | Gerstein |
| 2009/0064556 | A1 | 3/2009 | Fluhr et al. |
| 2010/0257768 | A1 | 10/2010 | Barrett |
| 2014/0075814 | A1 | 3/2014 | Larson et al. |
| 2016/0047611 | A1 | 2/2016 | Battaglia et al. |
| 2019/0277589 | A1 | 9/2019 | Fischbach et al. |

FOREIGN PATENT DOCUMENTS

| | | | | |
|---|---|---|---|---|
| DE | 101 22 345 | | 10/2002 | |
| DE | 10 2006 006 034 | | 10/2007 | |
| DE | 10 2018 001 984 | | 9/2019 | |
| EP | 0 207 058 | | 12/1986 | |
| EP | 0 489 024 | | 6/1992 | |
| EP | 3 677 867 | | 7/2020 | |
| FR | 1349766 | | 1/1964 | |
| FR | 3020870 | A1 * | 11/2015 | ..... F41A 19/34 |
| WO | 9102937 | | 3/1991 | |
| WO | WO-2020027747 | A1 * | 2/2020 | |

OTHER PUBLICATIONS

European Patent Office, "Extended European Search Report," issued in connection with European Patent Application No. 21193617.4, dated Jan. 25, 2022, 16 pages.

* cited by examiner

RECEIVERS FOR SELF-LOADING FIREARMS AND SELF-LOADING FIREARMS EQUIPPED WITH RECEIVERS

CROSS-REFERENCE TO RELATED APPLICATION

This patent application claims the benefit of and priority to German Patent Application No. 10 2020 122 930.5 filed Sep. 2, 2020, which is hereby incorporated herein by reference in its entirety.

FIELD OF THE DISCLOSURE

The present invention relates to a firearms and, more particularly to receivers for self-loading firearms and self-loading firearms equipped with receivers.

BACKGROUND

As used herein, positional terms such as "up," "down," "front," "rear," etc. relate to a self-loading firearm in which the bore axis is horizontal and shots are fired out a bore of the firearm toward the front, away from the shooter.

A weapon receiver is a component that receives a barrel, a trigger mechanism, a breech assembly, and a loading assembly.

A loading assembly loads a self-loading firearm by means of a loading lever to ready the firearm for firing. The sequence for firing and automatically reloading in a self-loading firearm can be simplified as follows:

There is a longitudinally movable breech assembly for firing a cartridge, ejecting a fired cartridge case, and reloading. In order to fire a cartridge, the breech assembly, which includes a bolt head, guides the uppermost cartridge from a magazine into a cartridge chamber in the barrel. When the trigger mechanism is actuated, a firing pin strikes the base of the cartridge and ignites a propellant, such that a projectile is shot out of the cartridge housing through the barrel. As the projectile passes through the bore in the barrel, a portion of propellant released during the firing process can be diverted into a gas uptake in a gas-operated loading system. The diverted propellant is used to reverse the movement of the breech assembly. The propellant drives the breech assembly backward toward the stock at high speed via the gas uptake and a piston rod coupled thereto.

In contrast to a gas-operated loading system in which propellant is diverted, a blowback loader is a system in which the cartridge is driven via the momentum of the projectile and the gases propelling the projectile. The momentum acts, in this case, directly on the bolt head via the cartridge case, thus moving the bolt head rearward.

In either a gas-operated loading system or a blowback system, the bolt head includes an extractor that encompasses a cartridge case at an edge of its base, and extracts the cartridge from the chamber when the breech assembly is retracted. An ejector then ejects the cartridge case from the receiver through a cartridge ejection opening. As the breech assembly moves from the forward position to the rearward position, the breech assembly slides backward over the magazine toward the stock. With the subsequent forward movement of the breech assembly, the bolt head again takes the uppermost cartridge from the magazine and guides it into the chamber, at which point the cycle repeats.

There is a recess on the upper surface of the upper end of both the rear wall and front wall of the magazine for guiding a cartridge. The lateral walls of a magazine are extended upward and form so-called magazine lips, which prevent the cartridge from falling out of the magazine. A spring in the magazine forces the cartridge feed upward in the magazine housing and pushes it and the cartridge upward to the magazine lips.

With so-called closed-bolt self-loading firearms, the breechblock (breechblock carrier and bolt head) is in its front position prior to firing (i.e., the bolt head is at the chamber). After placing a first, or potentially a new magazine, in the self-loading firearm, the loading specified in the introduction is then carried out.

With a so-called open-bolt breech, the breechblock is moved to a rear position prior to shooting (in front of the curve of the trigger) by the loading lever, where it is retained by the trigger mechanism.

Known loading mechanisms are frequently attached directly to the breechblock, and the breechblock can be moved by the loading lever to the rear (i.e., toward the stock) such that the breechblock is moved backward over the magazine, counter to the force of the closing spring. When the breechblock subsequently moves forward, the bolt head takes the uppermost cartridge from a magazine and guides it forwards, into the chamber, while the loading lever attached to the breechblock follows all of the movements of the breechblock.

BRIEF DESCRIPTION OF THE DRAWINGS

Exemplary embodiments of the invention shall be explained in greater detail below in reference to the attached schematic drawings.

DETAILED DESCRIPTION

The construction and functioning of the weapon receiver for a self-loading firearm that has a breechblock guided longitudinally in the receiver, or the self-loading firearm that has such a receiver, shall be explained below in reference to the figures. The figures show example and preferred embodiments.

For purposes of clarity, not all of the reference symbols are inserted in all of the figures. The same reference symbols nevertheless apply in all of the figures.

Figure 1:
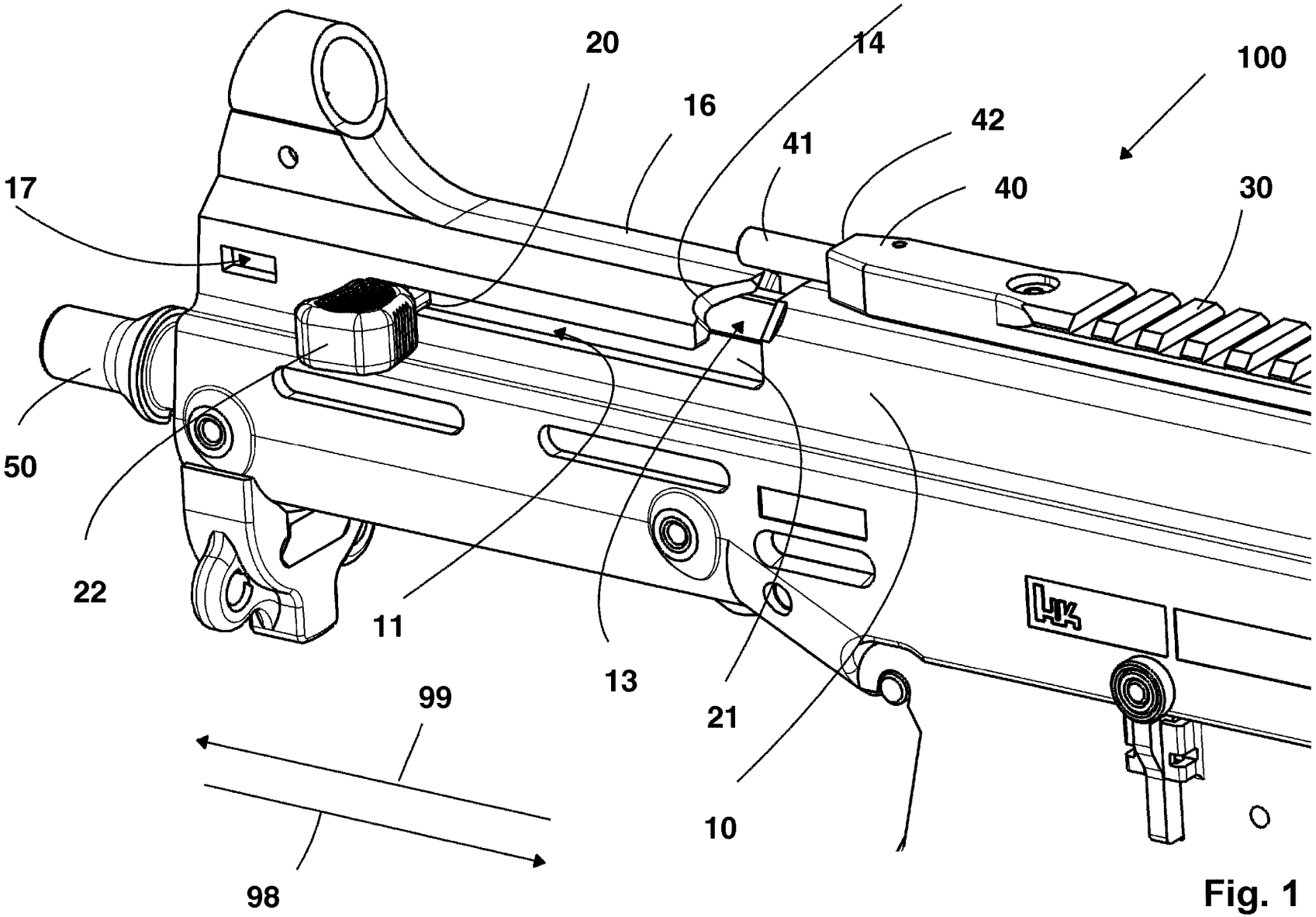
FIG. 1 shows a perspective side view of a section of a weapon receiver for a self-loading firearm in a preferred embodiment, and the position of the loading lever in a first moment.

FIG. 1 shows a section of a self-loading firearm 100 with which the receiver according to the invention is used. The self-loading firearm is the Universal Machine Pistol (UMP), by way of example, a closed-bolt blowback-operated SMG, by the applicant. The view shows the left side of the self-loading firearm 100, or the receiver 10. FIG. 1 also represents the self-loading firearm 100 at a moment in time.

The receiver 10 for the self-loading firearm 100 includes a first guide track 11 in the form of a longitudinal slot, and a second guide track 12 opposite the first guide track 11, in the form of a longitudinal slot, wherein the second guide track 12 is hidden by the receiver in the perspective of FIG. 1. The first guide track 11 and second guide track 12 are connected to one another by a first opening 13. The first opening 13 is located in the rear of the guide tracks 11, 12.

As shown in FIG. 1, the self-loading firearm 100 also has a loading lever 20 in the first guide track, which is mechanically coupled to the loading tube 21. The loading lever 20 can move longitudinally in the first guide track, and has a handle 22, by means of which a user can move the loading lever 20. FIG. 1 shows the loading lever 20 at its front end position. The loading lever 20 can be moved back 99 from this position, such that the loading tube 21 is brought back, into mechanical contact with the breechblock, counter to the force of the closing spring. If the loading lever 20 has been moved back 98 as far as possible, it is in the rear end position. The backward 98 movement of the loading lever corresponds to movement toward the stock.

The first and second guide tracks also have a recess for locking the loading lever 20 in place, such that the loading lever 20 can be locked in place on either the left or right side of the receiver 10. If the loading lever is rotated at its rear position about the rotational axis of the loading tube 21, it can be secured in place in a first recess.

There is a second recess 15 lying opposite the first recess 14 (i.e., on the right side of the receiver) with which the loading lever can be locked in place if it is guided in the second guide track.

The recesses 14, 15 are in the opening 13 (i.e., the opening that connects the first guide track 11 to the second guide track 12). In other words, the recesses 14, 15 are part of the first opening 13.

The recesses 14, 15 each have a semicircular extension in the direction of the arrow 99 (i.e., in the longitudinal direction) toward the front. The movement of the loading lever in this direction 99 corresponds to movement toward the muzzle 50.

The first and second recesses are also separated from one another by a receiver portion 16 in the upper part of the receiver 10. According to this example, the receiver portion 16 extends over the two recesses 14, 15 in the direction of the arrow 98 (i.e., toward the stock).

The weapon receiver 10 also has a profile rail 30 on its upper surface, on which accessories can be mounted. There is a safety device 40 with a safety element 41 at the front end of the profile rail 30. The safety device 40 in this embodiment is an integral part of the profile rail 30. In this regard, it is an "extended" Picatinny rail. The safety device 40 can also be a separate component, however. It is therefore conceivable to design the safety device 40 as a modular accessory that is then mounted on the front end of a known Picatinny rail.

The safety element 41 is in the form of a cylindrical pin on the end surface 42 of the safety device 40, or the profile rail 30, respectively. The safety element 41 can be moved back and forth between a first position and a second position, wherein when the safety element 41 is in the first position, it prevents movement of the loading lever 20 from the first guide track to the second guide track 12, or vice versa, and it allows this movement in the second position. The safety device 40 is also configured to retain the safety element 41 in the first position and in the second position.

For this, the safety element 41 can move longitudinally, and is spring loaded (not shown). The safety device 40 also comprises a gearing (not shown), which interacts with the spring such that the safety element 41 can be retained in the first and second positions, without the effects of an external force.

FIG. 1 shows the safety element 41 in the first position. In this position, the loading lever 20 cannot be shifted from the first guide track 11 to the second guide track 12.

If the loading lever 20 is reversed, the user moves the safety element 41 in the direction of the arrow 98, until it locks in place. The safety element 41 is then in the second position. The loading lever can then be reversed. The safety element 41 can then be moved from the second position to the first position by pressing it in the direction of the arrow 98.

The weapon receiver 10 also has at least one counter-latch, in which a latching element on the loading lever locks in place. If the loading lever 10 is latched in the counter-latch, the loading tube 21 is secured in place on the receiver 20 and does not move along with the breechblock when the breechblock moves. The counter-latch is formed by a second opening 17 and a third opening 18 in the receiver 10 according to this example. The second opening 17 is located in the front of an extension of the first guide track 11 and is therefore located axially between the muzzle 50 and the first guide track 11.

The second opening 17 is rectangular, extending in the longitudinal direction, wherein the upper boundary of the second opening 17 and the upper boundary of the first guide track form a straight line. The third opening 18 is covered by the receiver. It is symmetrical to the second opening 17 on the right side of the receiver 10.

When the loading lever 20 is in this position, the latching element on the loading lever 20 is locked in place in the third opening 18.

The loading lever 20 can pivot within the loading tube on a spring. The handle is moved backward to release or unlatch the latching lug 23 form the third opening. The loading lever 20 is placed in the loading tube such that a backward movement first causes a pivotal movement about a vertical axis, thus removing the latching lug 23 from the third opening 18.

As mentioned above, FIG. 1 shows the loading lever in the front end position. The reversal of the loading lever 20 from the first guide track 11 to the second guide track 12 shall be explained in reference to the subsequent FIGS. 2 to 10. The subsequent FIGS. 2 to 10 represent successive moments in time.

Figure 2:
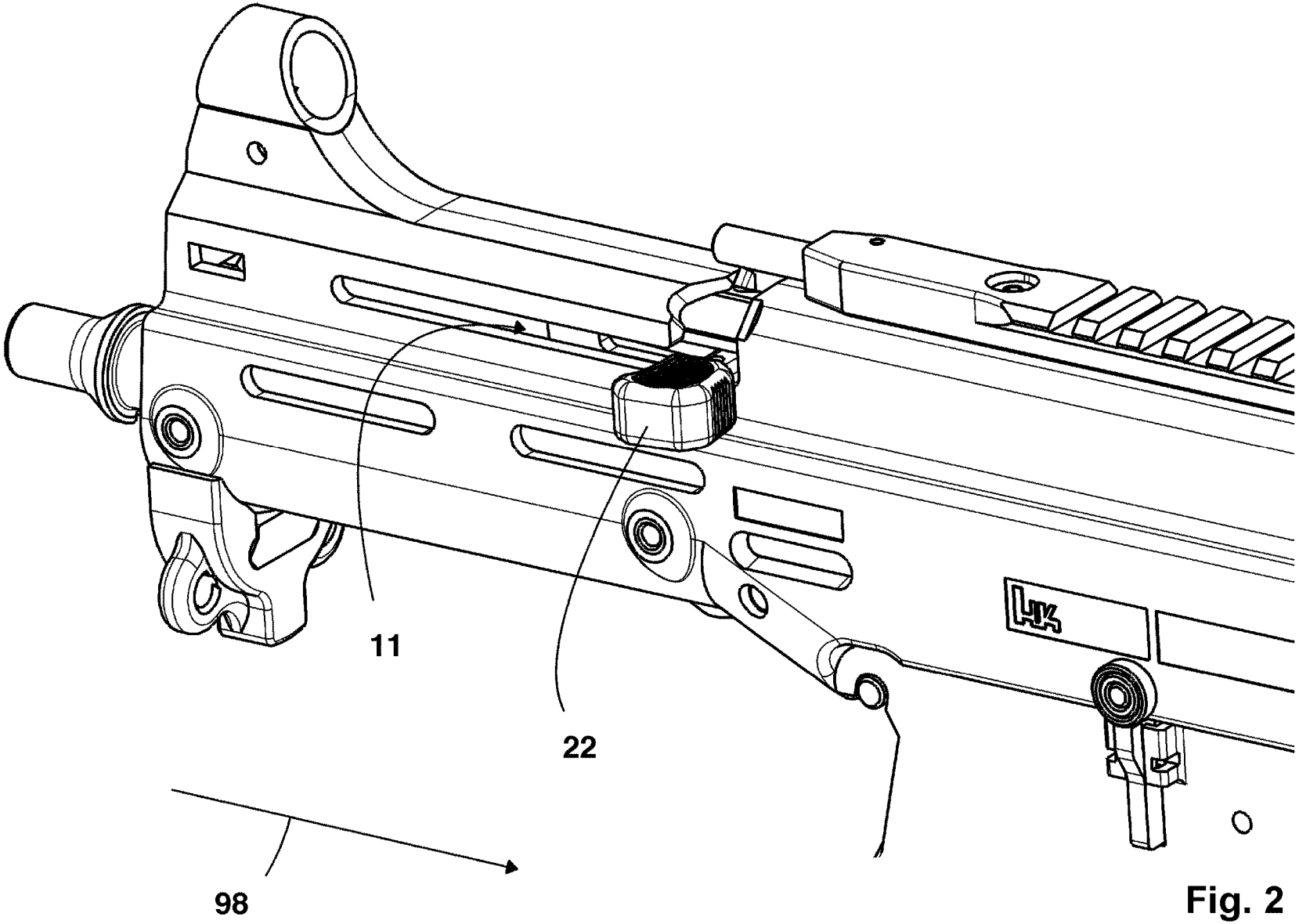
FIG. 2 shows the position of the loading lever in a second moment.

FIG. 2 represents a second moment in time and shows the loading lever 20, or the handle 22, in the first guide track 11 at its rear end position. The closing spring for the breech is then compressed as far as possible. The hand of the user holding the handle 22 is not shown.

Figure 3:
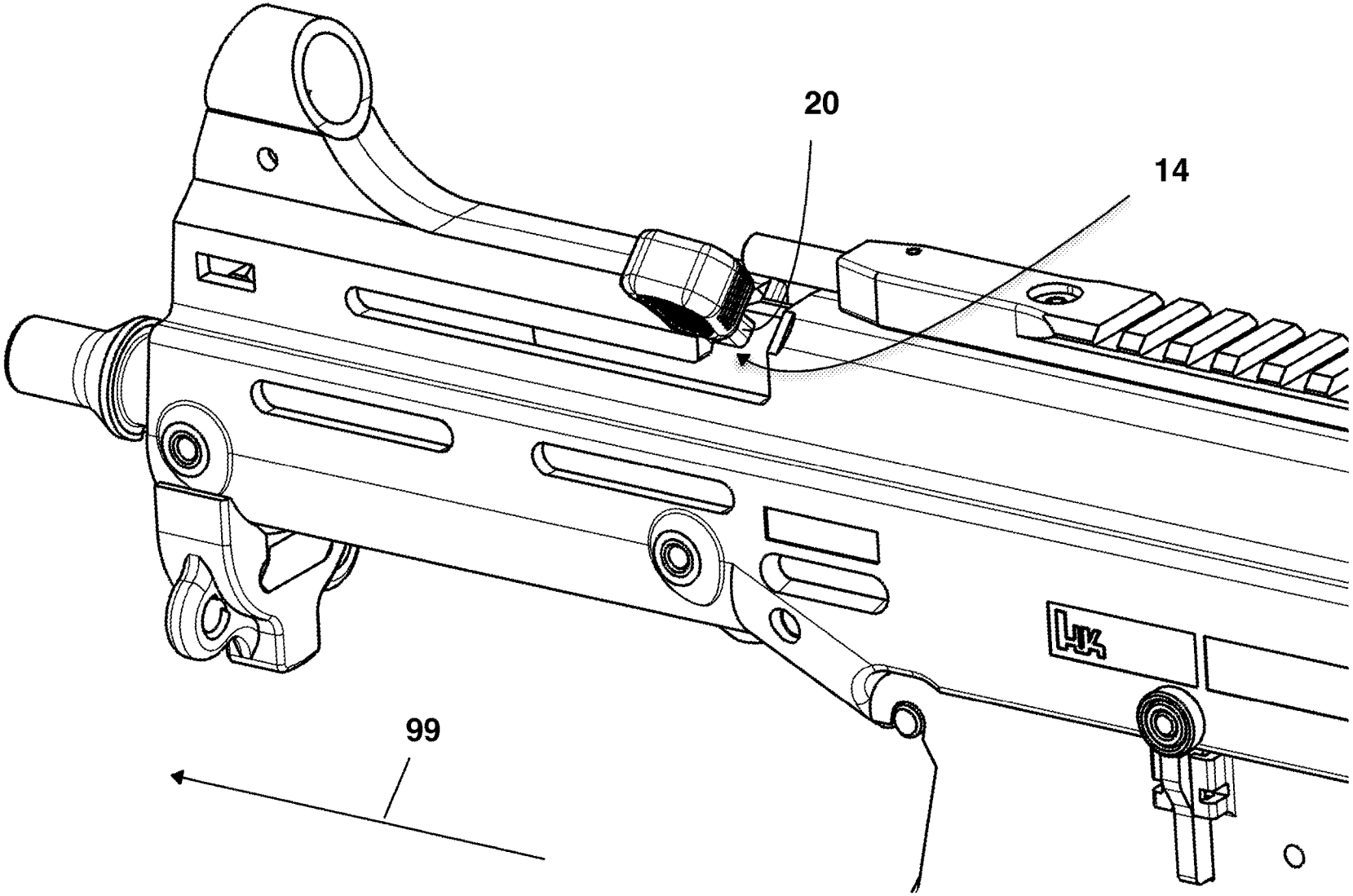
FIG. 3 shows the position of the loading lever in a third moment.

FIG. 3 represents a third moment in time. The tensioned loading lever 20 locks in place in the first recess 14 after it is pivoted to the right and moved forward 99. The first recess 14 encompasses the loading lever 20 such that it cannot slip downward out of the first recess 14. The user can then release the handle.

Figure 4:
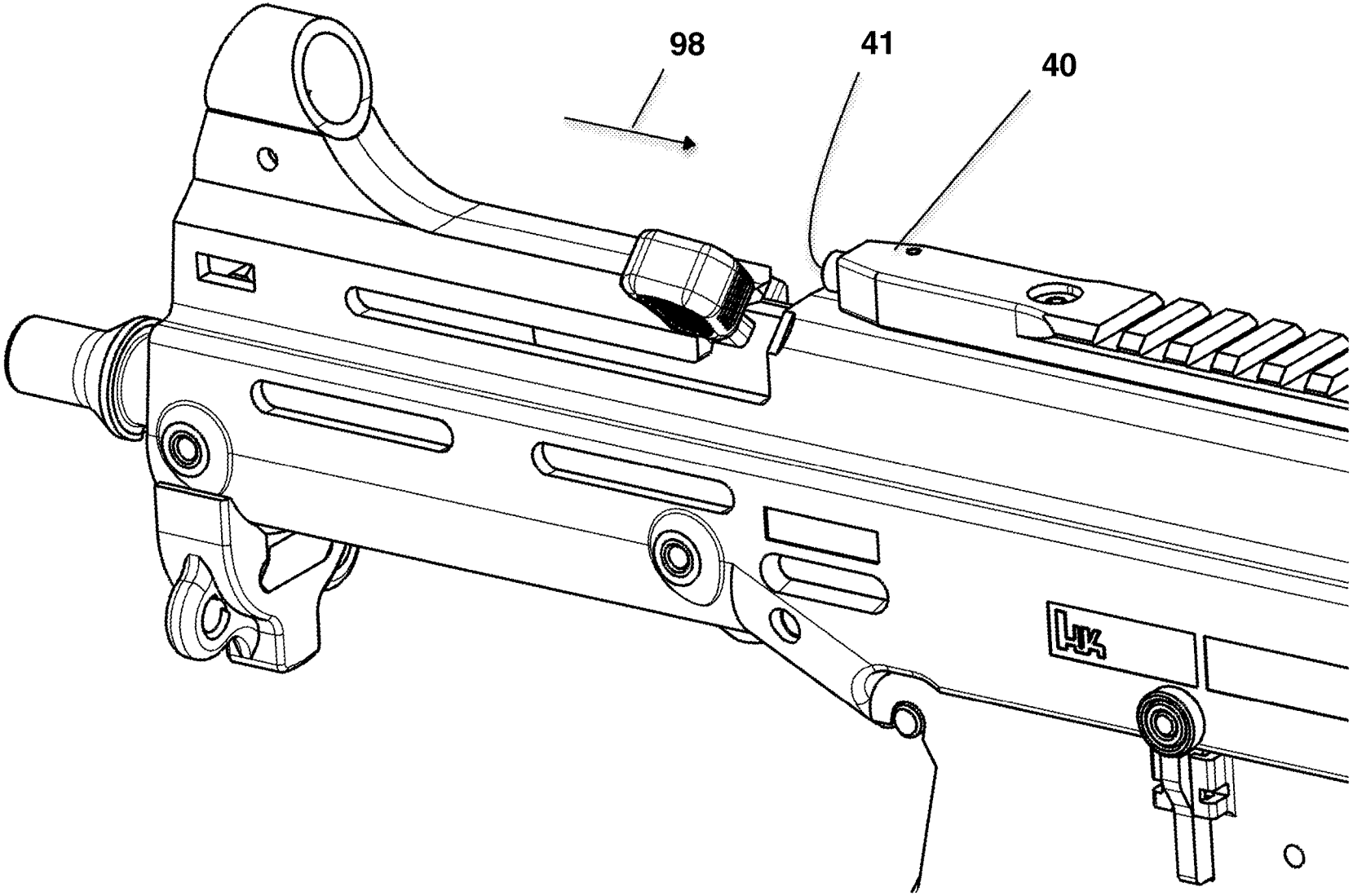
FIG. 4 shows the position of the loading lever in a fourth moment.

FIG. 4 represents a fourth moment in time. The tensioned loading lever 20 remains locked in place in the first recess 14. The safety pin 41, however, has now been moved along the direction of the arrow 98 from the first position to the second position. The user's hand pushes the safety pin 41 inward until it latches in place. The safety pin is held in the second position by the safety device. The loading lever 20 can then be reversed when the safety pin 41 is in the second position.

Figure 5:
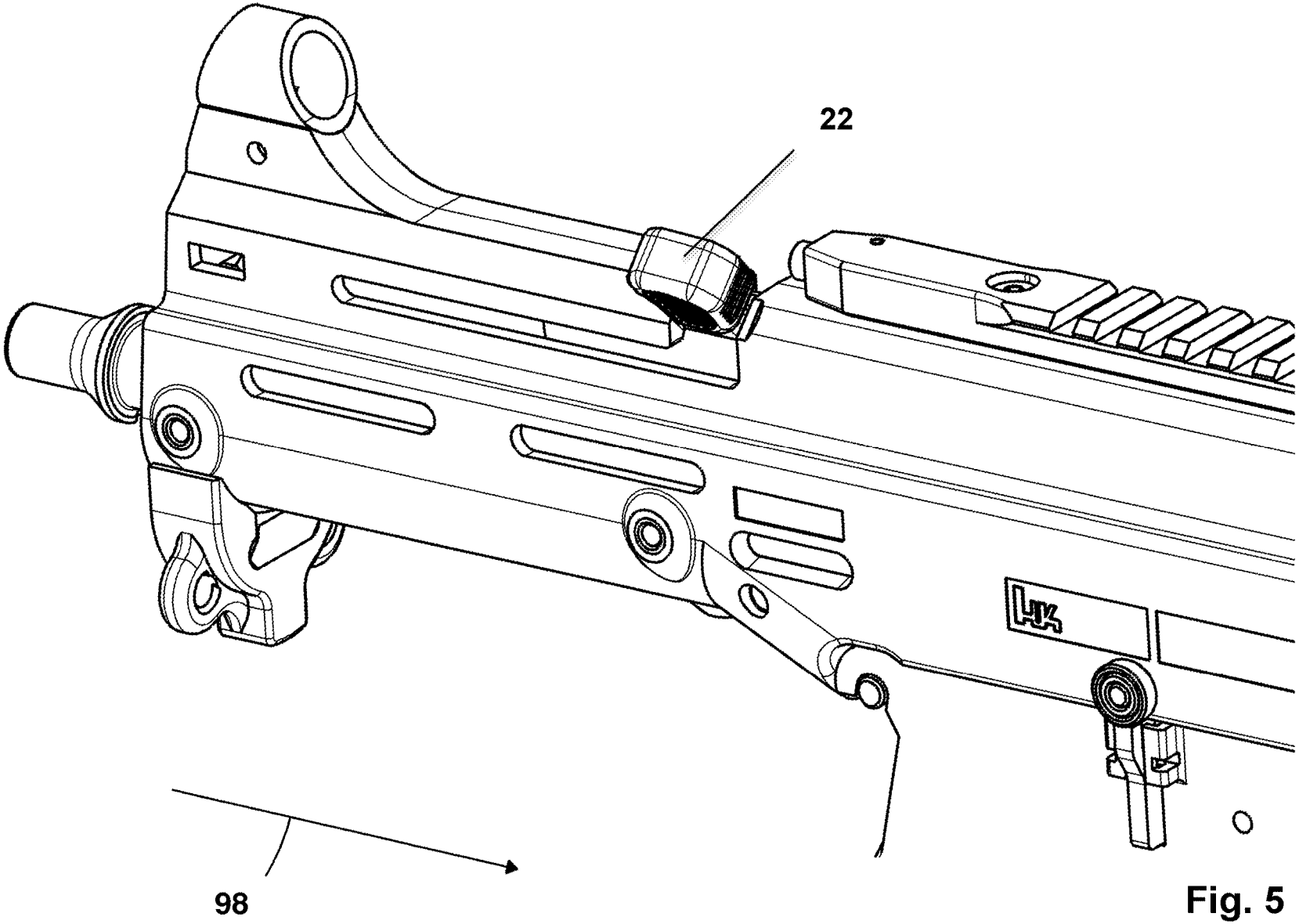
FIG. 5 shows the position of the loading lever in a fifth moment.

FIG. 5 represents a fifth moment in time. The loading lever 20, or the handle 22, has been moved from the first recess 14 in the direction of the arrow 98, and is then shifted toward the right.

Figure 6:
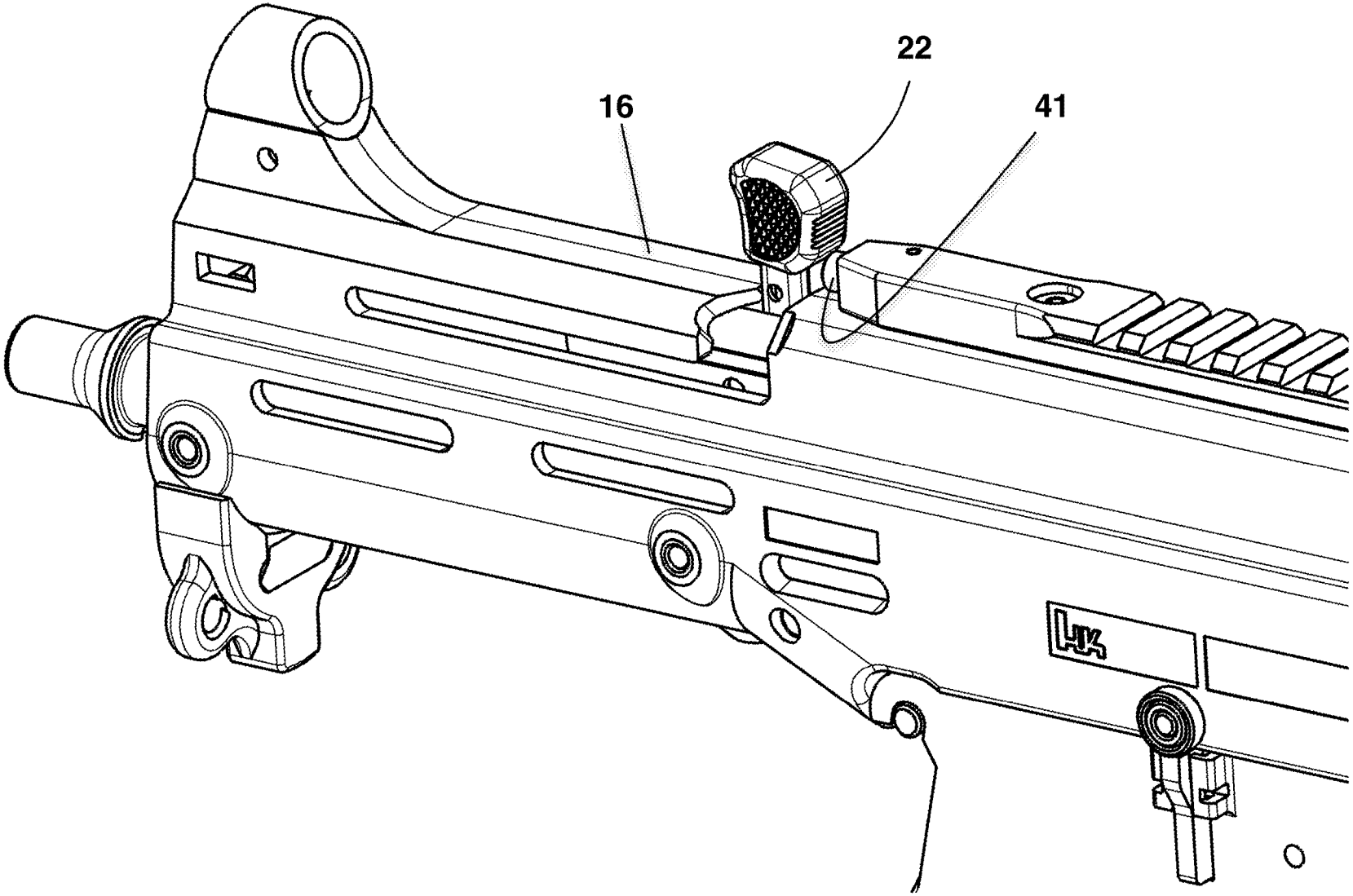
FIG. 6 shows the position of the loading lever in a sixth moment.

FIG. 6 shows a sixth moment in which the loading lever 20, or the handle 22, is in the middle (i.e., between the receiver portion 16 and the safety element 41).

Figure 7:
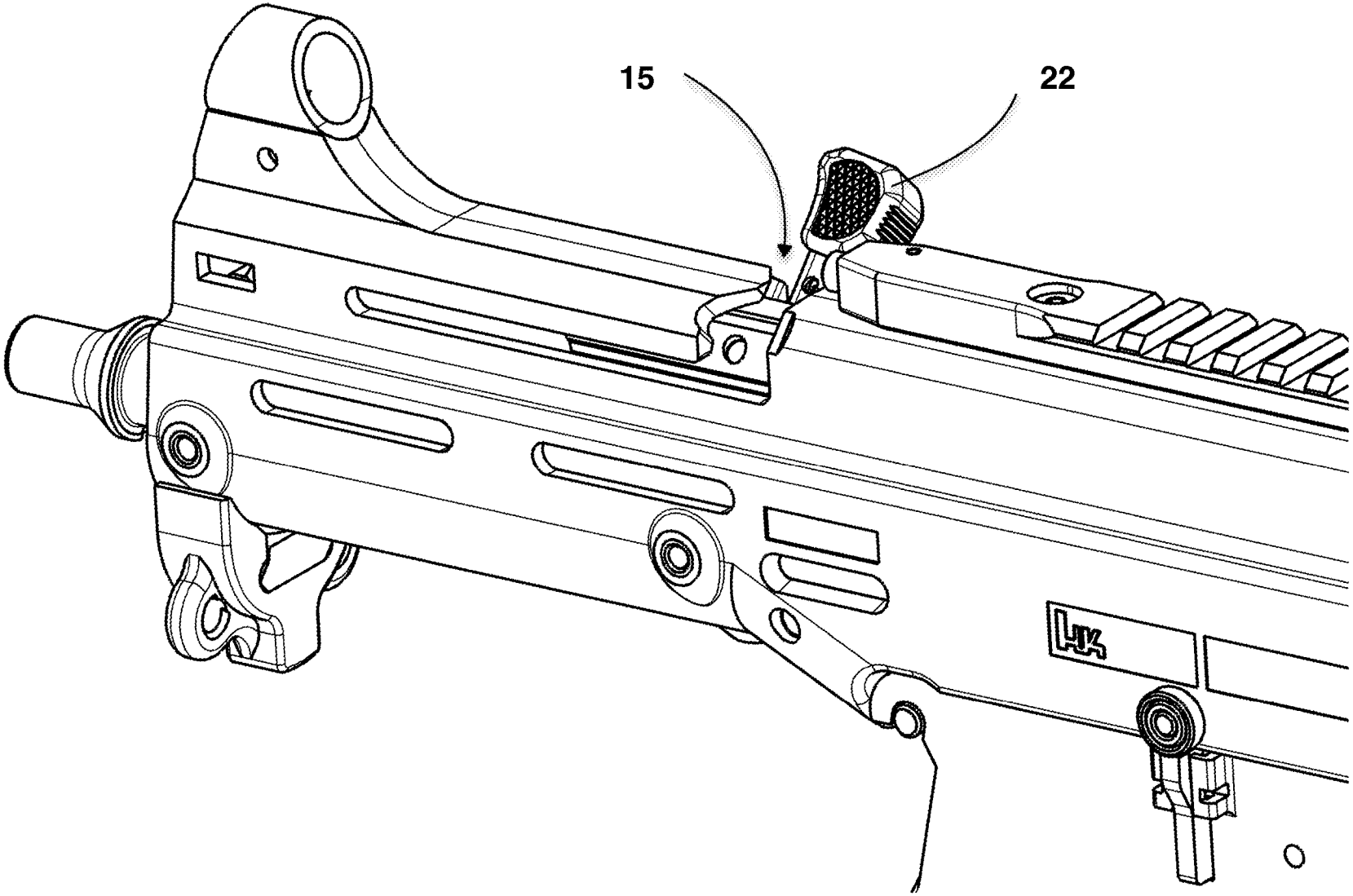
FIG. 7 shows the position of the loading lever in a seventh moment.

FIG. 7 shows a seventh moment in time. The loading lever 20, or the handle 22, has now been shifted somewhat to the right. In this moment, the handle 22 is still held by the hand near the second recess 15.

Figure 8:
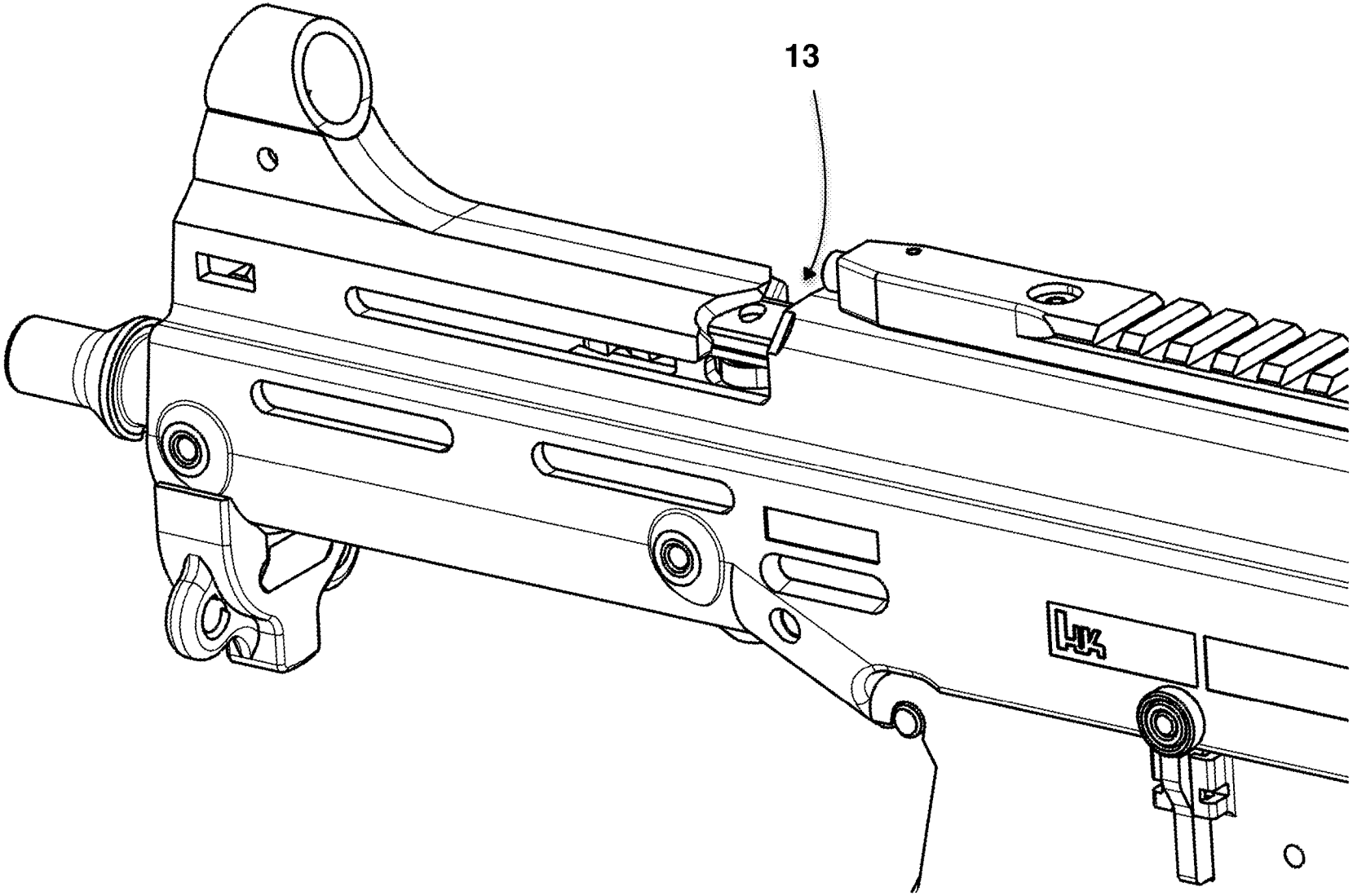
FIG. 8 shows the position of the loading lever in an eighth moment.

FIG. 8 shows an eighth moment in time. The loading lever 20, and handle 22, hidden by the receiver 10, are now in the second guide track 12 at the rear end position, analogous to the position of the loading lever 20 shown in FIG. 2.

Figure 9:
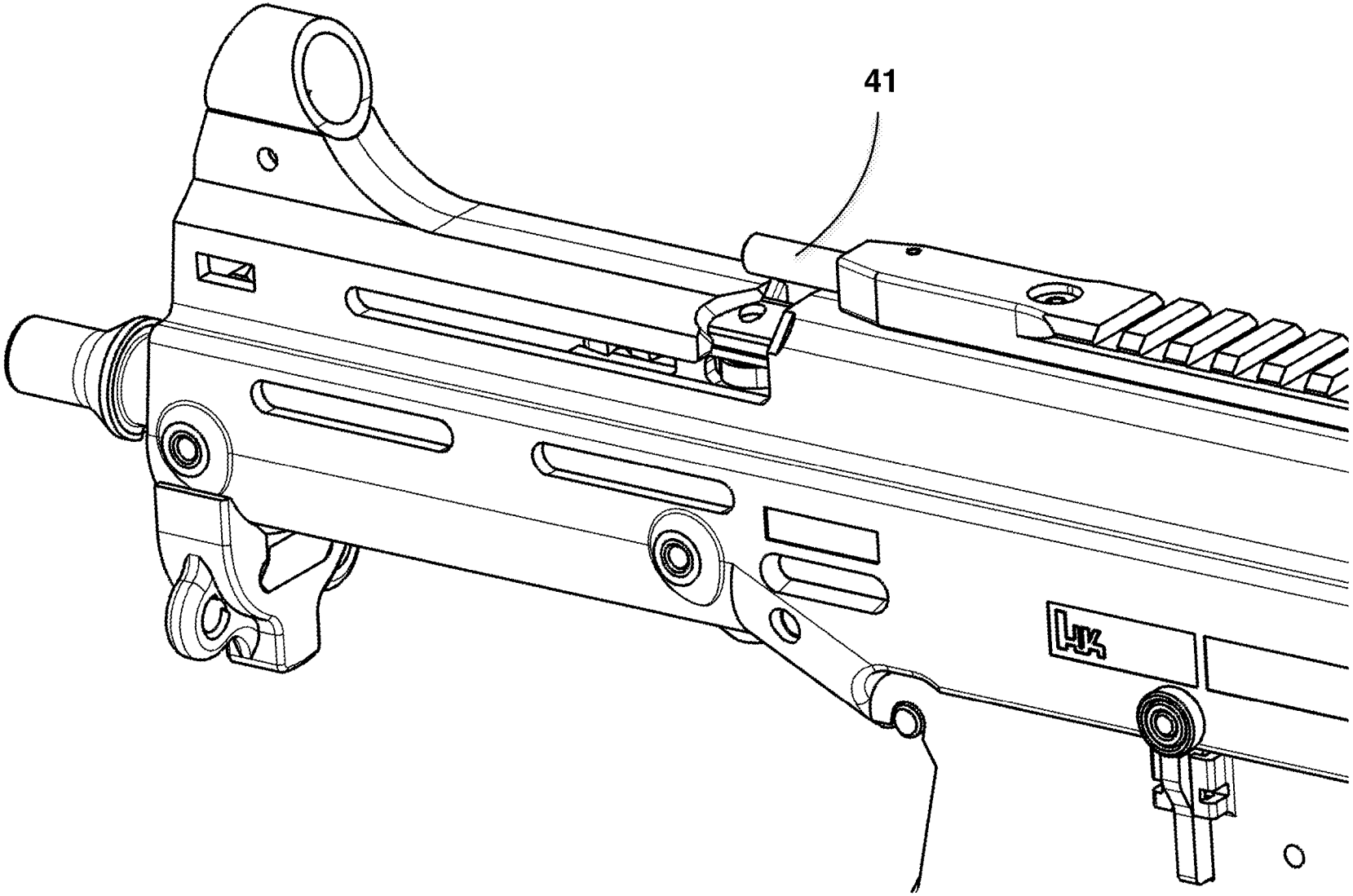
FIG. 9 shows the position of the loading lever in a ninth moment.

FIG. 9 shows a ninth moment in time. The safety pin has been moved from the second position back to the first position.

Figure 10:
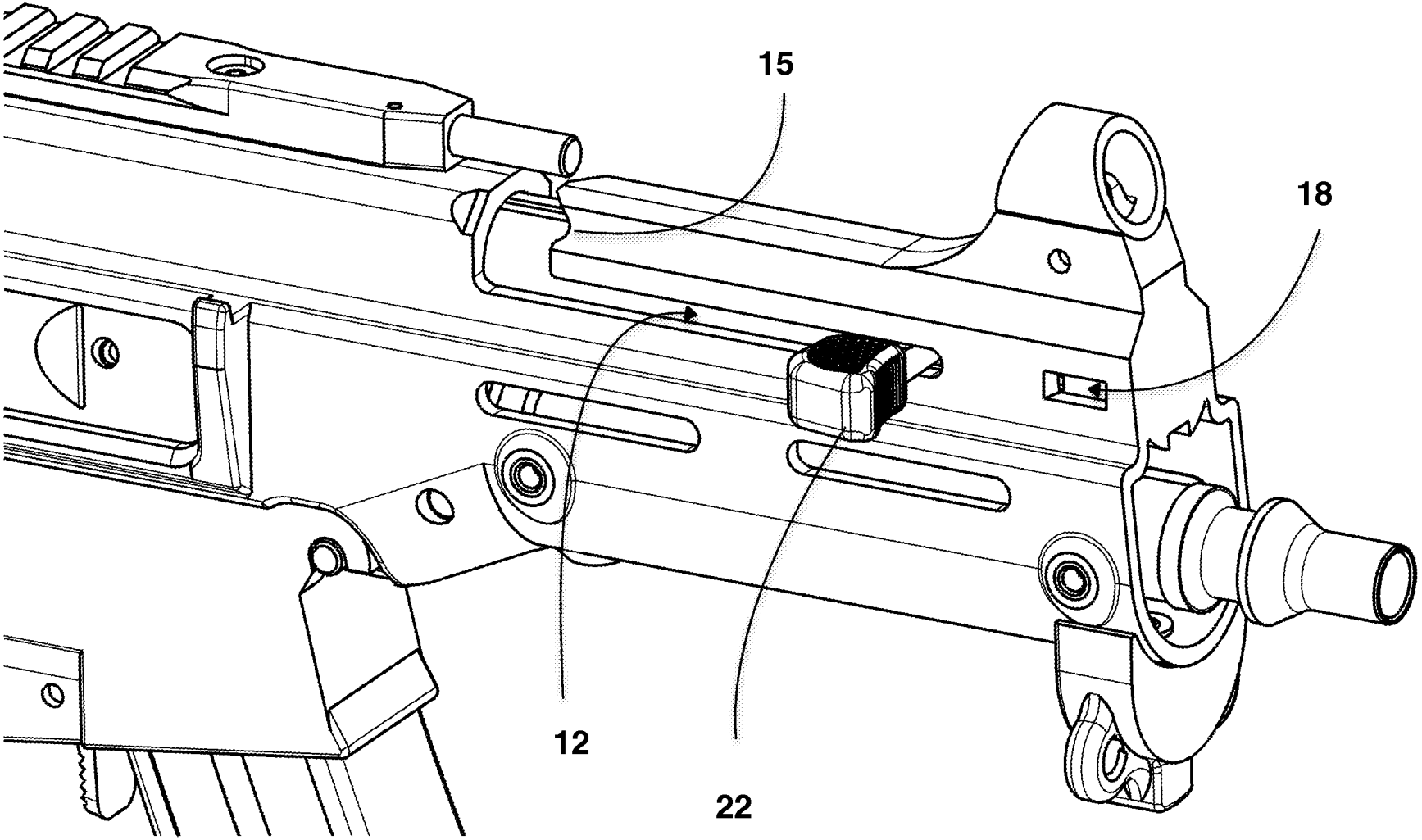
FIG. 10 shows a second perspective side view of the section shown in FIG. 1, and the position of the loading lever in a tenth moment.

FIG. 10 shows a tenth moment in time. This view shows the receiver 10, or the self-loading firearm 100, from the right-hand side. The loading lever is now in the second guide track 12 at its front end position. The latching lug on the loading lever 20 is locked in place in the opposite, second opening 17.

Figure 11:
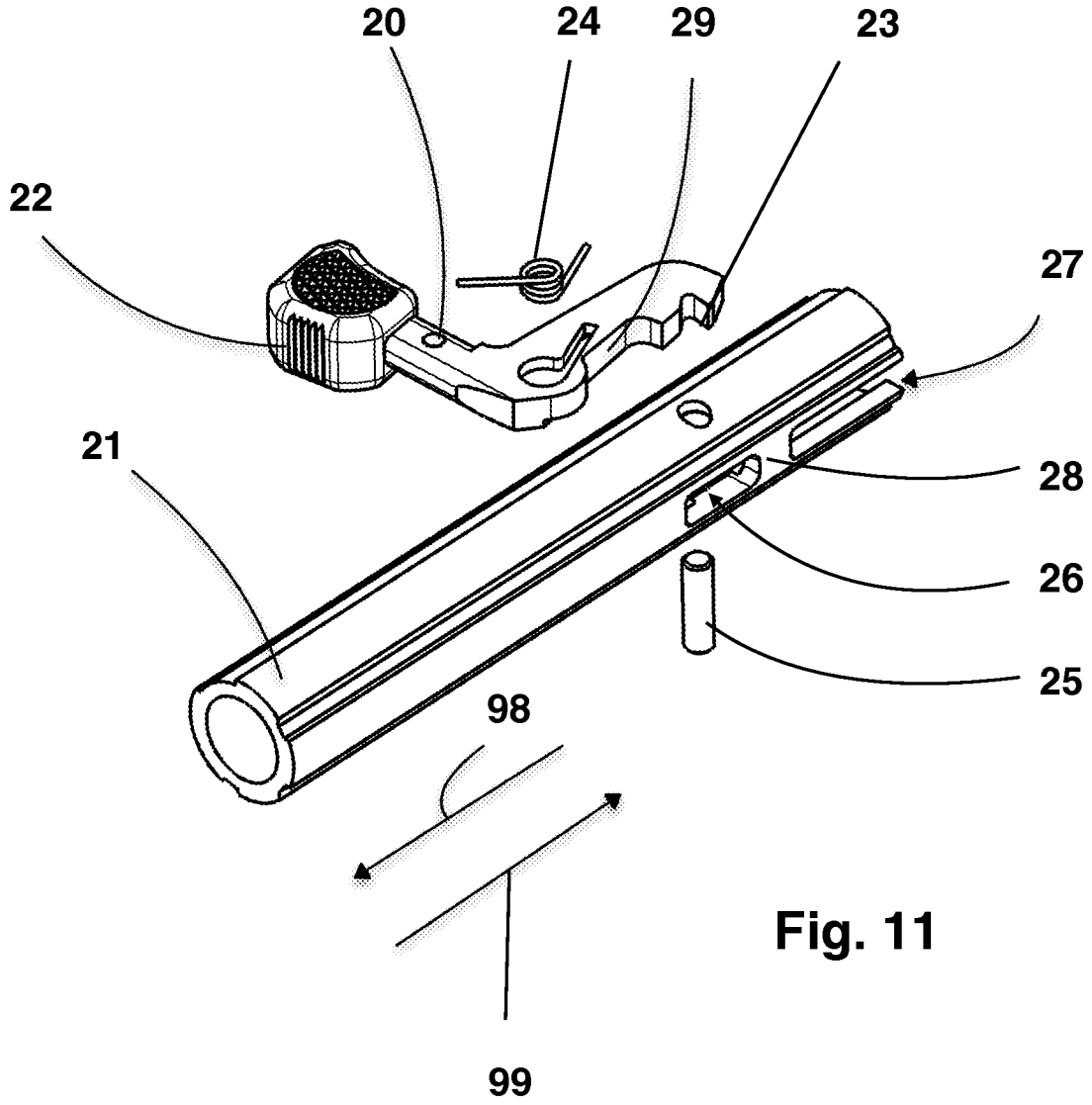
FIG. 11 shows a loading device in an exploded view.

FIG. 11 shows the loading device in an exploded view. The loading device comprises a substantially L-shaped loading lever 20, that has a contoured handle 22 at the end of one of its legs, and a latching element 23 in the form of a latching lug at the end of its other leg. The latching lug faces forward (i.e., in the direction of the arrow 99).

The loading lever 20 can be inserted laterally through an oblong hole (hidden in FIG. 11) into the loading tube 21. The pin 25 also forms the axis about which the loading lever 20 can be pivoted, either counter to or with the force, or torque, of the leg spring 24. The leg spring is pretensioned, such that it exerts a constant torque on the latching lug 23 toward the second or third opening 14, 15 lying opposite the handle 22. This results in a reliable locking of the loading lever 20 in place in the front end position. The latching lug 23 can be moved out of the respective opening 14, 15 by the user, counter to the force of the leg spring 24, e.g. in order to execute a loading process or reverse the loading lever.

The loading tube has another oblong hole 26 and an open oblong hole 27, separated by a web 28, on the side lying opposite the hidden oblong hole. A part of the loading lever 20 can be moved through the oblong hole 26 extending in the longitudinal direction. In other words, the oblong hole 26 provides a pivotal radius for pivoting the loading lever 20. The latching lug 23 can engage in the second or third opening 14, or 15, through the oblong hole 27. A part 29 of the loading lever 20 can bear on the web 28.

Figure 12:
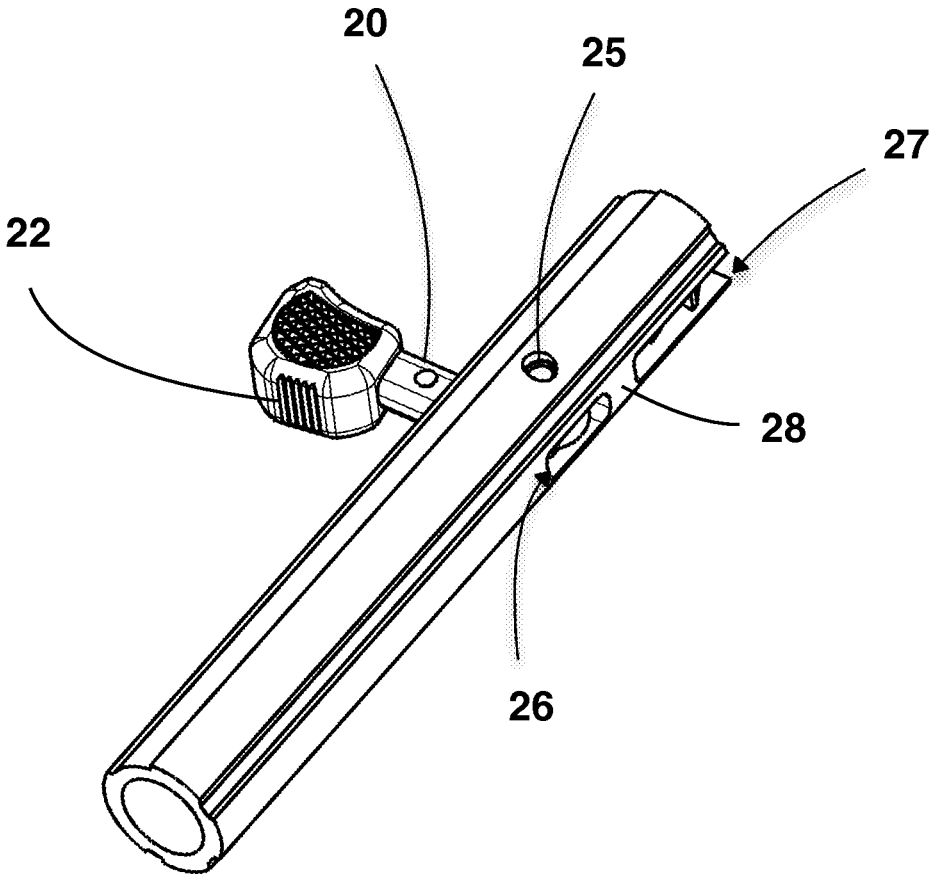
FIG. 12 shows the loading device from FIG. 11 in an assembled state.

FIG. 12 shows a loading lever 20 and a loading tube 21 in an assembled state, in a perspective view. The handle 22, pin 25, oblong holes 26, 27, and the web 28 can also be seen therein.

Figure 13:
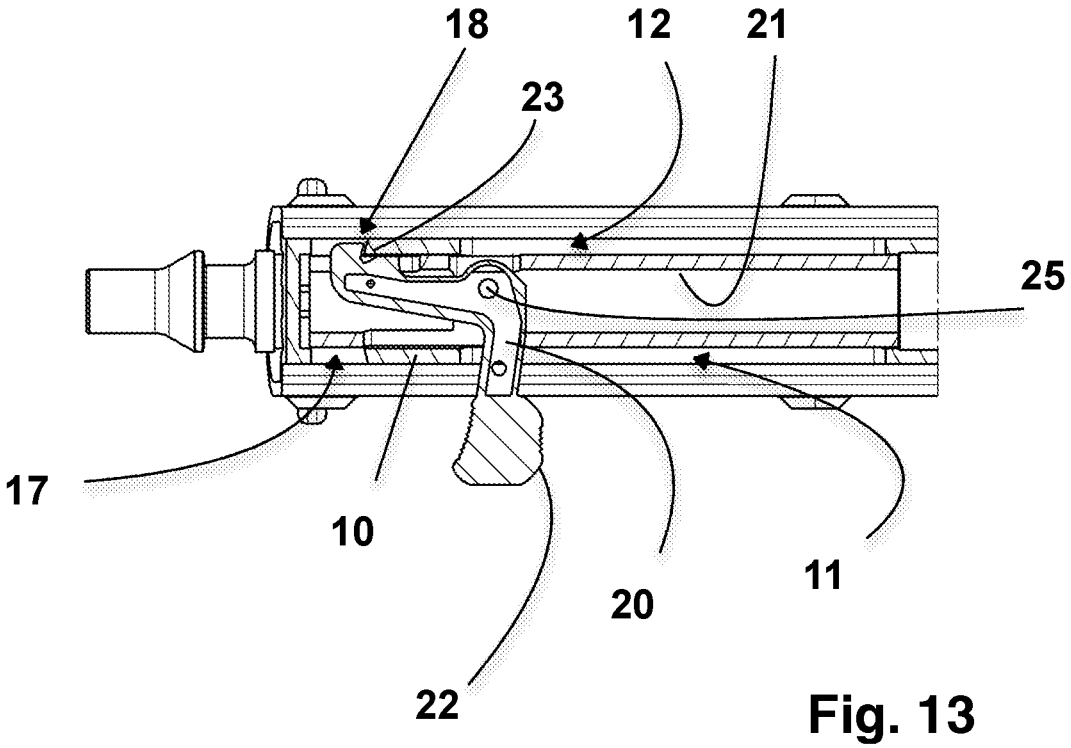
FIG. 13 shows a top view of an enlarged section of the front part of the self-loading firearm shown in FIG. 1 and the loading lever locked in position, in a cutaway view.

FIG. 13 shows a top view of the receiver 10 as well as the loading device shown in greater detail in FIGS. 11 and 12, in a cutaway. The guide track 11 and the extension of the second recess 17 are located on the left of the receiver. The loading lever 20 is in the first guide track 11, and at its front end position. The latching lug 23 on the loading lever 20 is locked in place in the third recess 18.

The latching lug 23 is pushed by the spring torque of the leg spring (not shown) through the oblong hole 27 in the loading tube 21. The latching lug 23 engages through the oblong hole 27 in the recess 18 and bears on a boundary of the recess 18. The loading lever 20, and therefore the loading tube 21 are thus secured in place on the receiver 10. The loading lever can pivot about the axis of the pin 25, and can be released by pivoting the handle.

Figure 14:
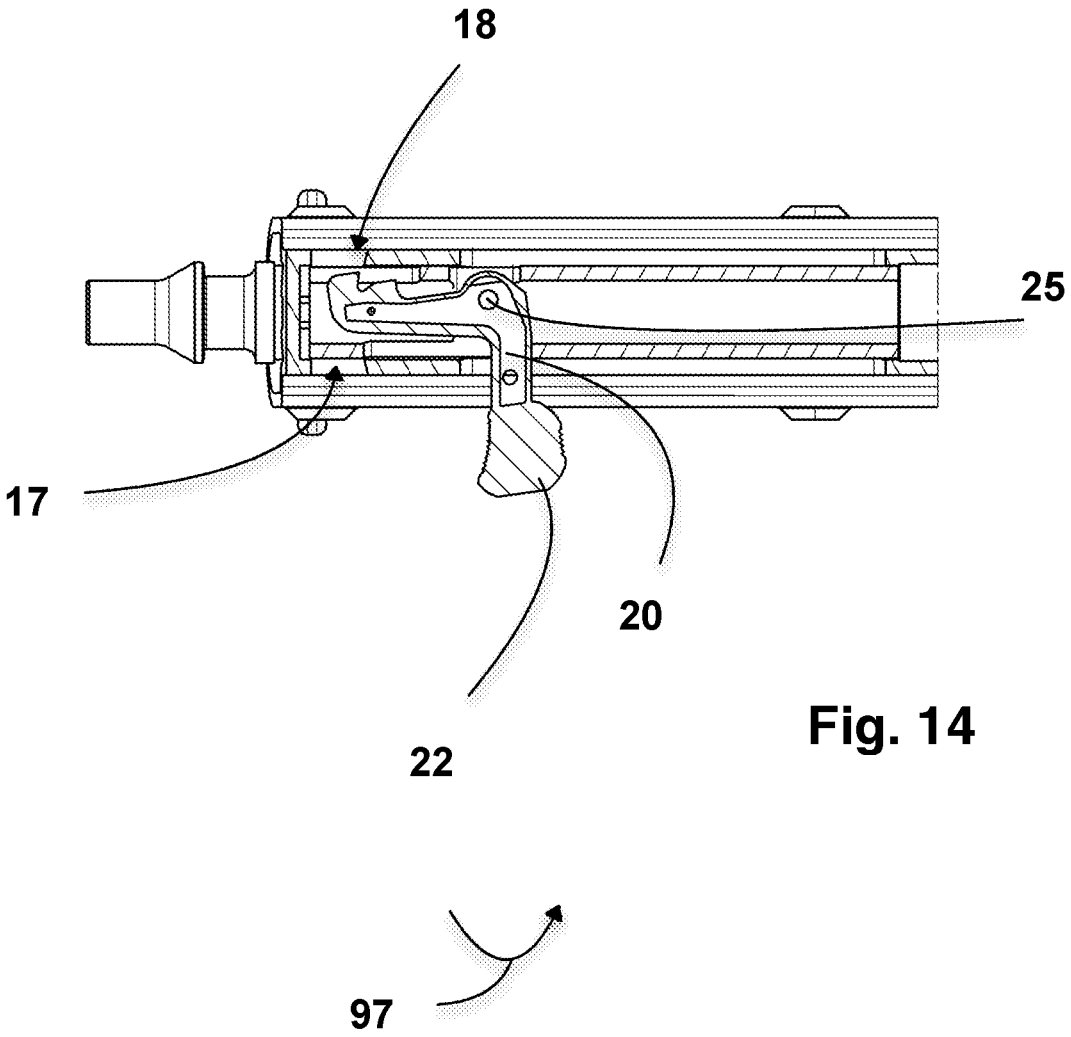
FIG. 14 shows the loading lever from FIG. 13 in an unlocked position.

FIG. 14 shows the loading lever from FIG. 13 in the released state. The handle 22 is first pivoted in the direction of the arrow 97 about the axis of the pin 25, and subsequently moved in the direction of the arrow 98. This view clearly shows that the third recess 18 extends further to the rear on the outside of the weapon than on the inside. In other words, the third recess 18 has a trapezoidal cross section. This profile, tapering from the outside toward the inside, results in a secure latching of the latching lug 23, and hinders an unintentional release of the latching lug 23 when it is locked in place. The second recess 17 has a corresponding geometry (i.e., a likewise trapezoidal cross section).

Figure 15:
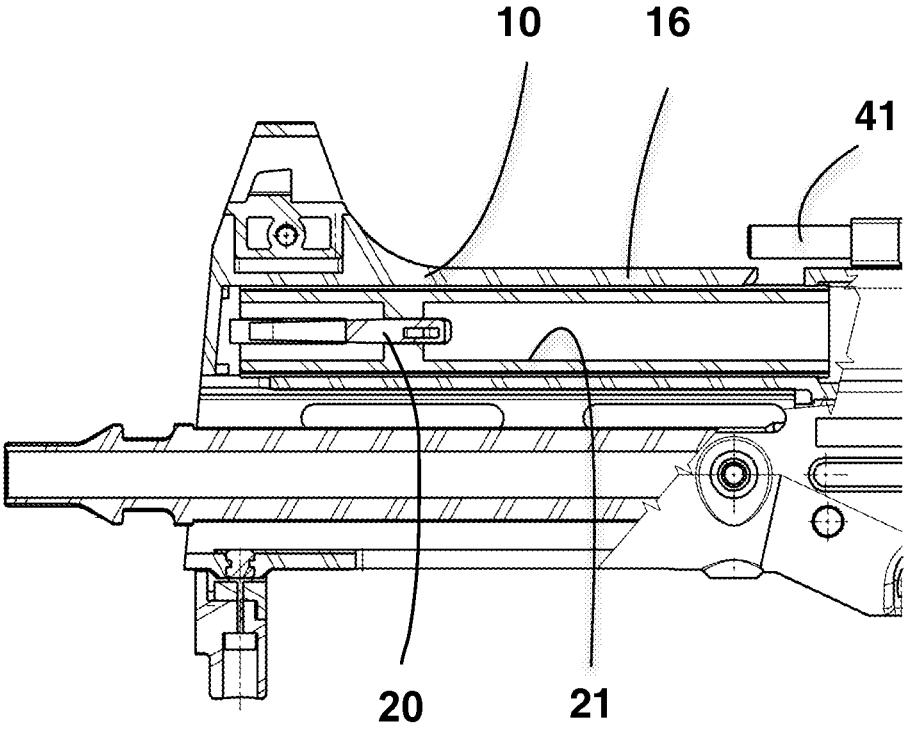
FIG. 15 shows a side view of the section shown in FIG. 13, in a cutaway view.

FIG. 15 shows the detail in FIG. 13 in a vertical cutaway. The loading lever 20 and loading tube 21 are in the front end position, in an unlocked state. It can be clearly seen in this view that the safety element 41 completely covers the first opening 13 in the axial direction, and at least partially covers the receiver portion 16 of the receiver 10. It is also conceivable for there to be a safety element that only partially covers the opening 13. With an appropriate thickness of the loading lever 20, the safety element 41 only needs to cover one half to two thirds of the opening 13.

Figure 16:
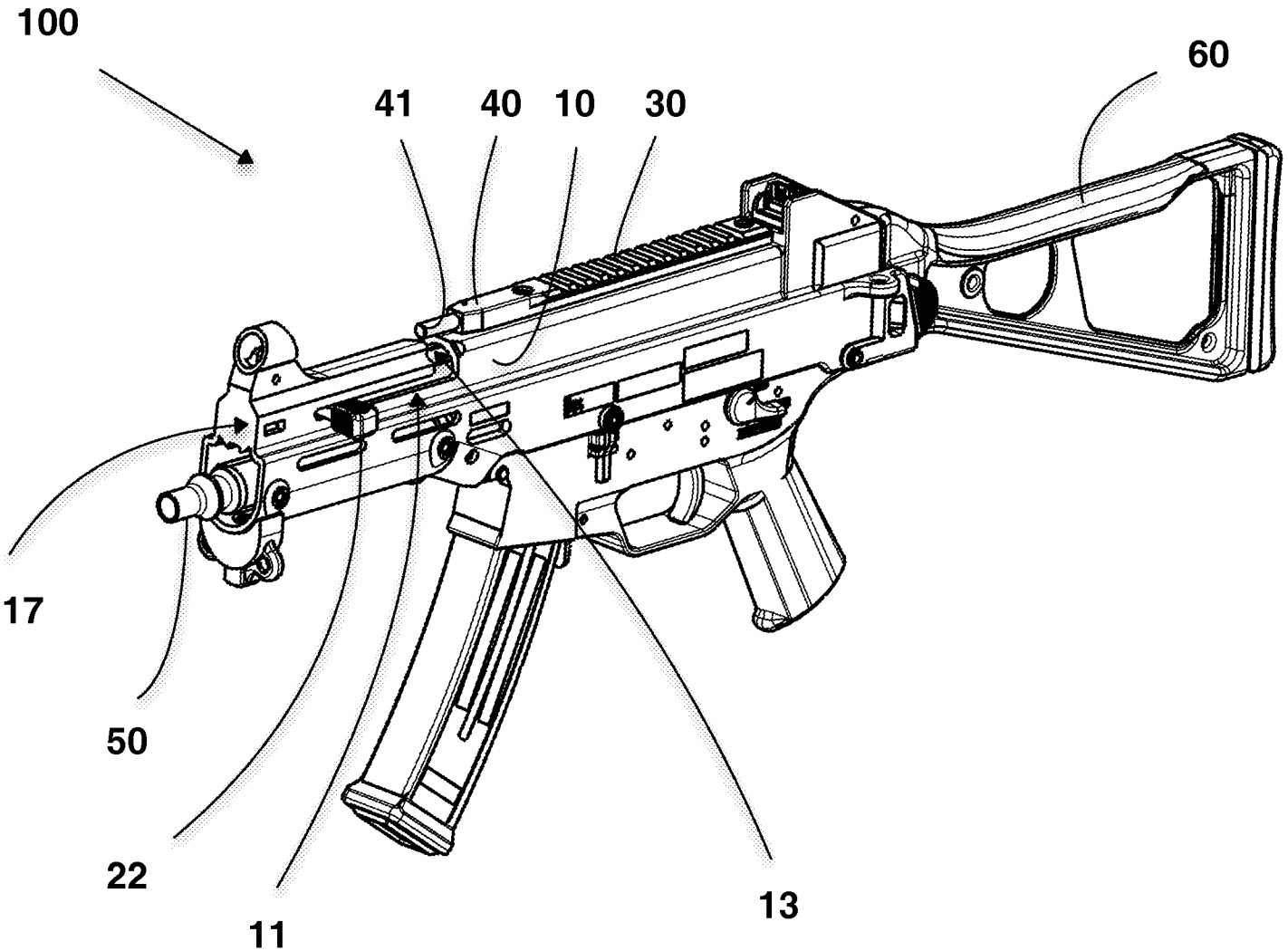
FIG. 16 shows a perspective view of the entire weapon receiver, or self-loading firearm shown in FIG. 1.
Figure 17:
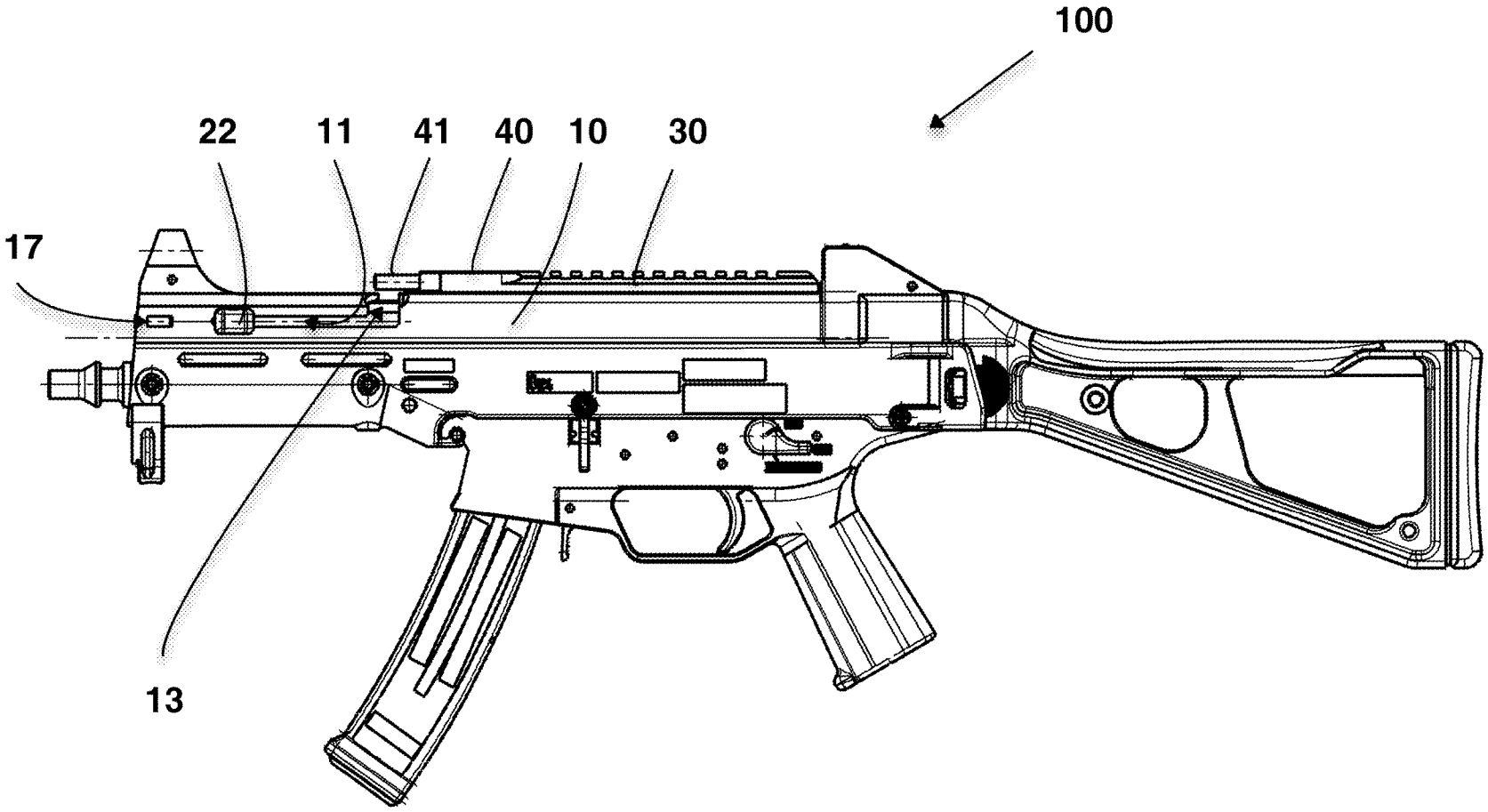
FIG. 17 shows a first side view of the entire weapon receiver, or self-loading firearm shown in FIG. 1.
Figure 18:
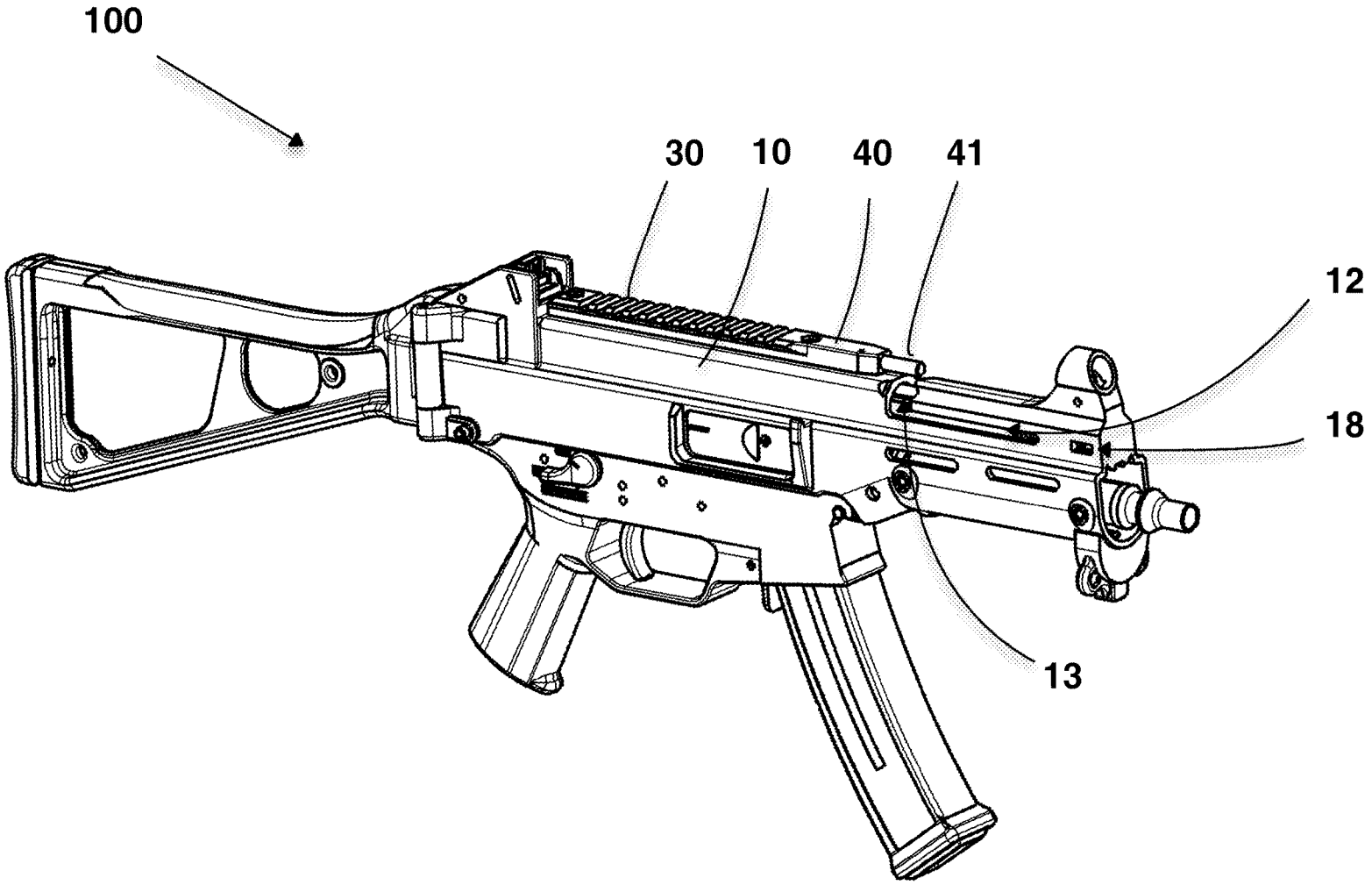
FIG. 18 shows a second perspective view of the entire weapon receiver, or self-loading firearm shown in FIG. 1.
Figure 19:
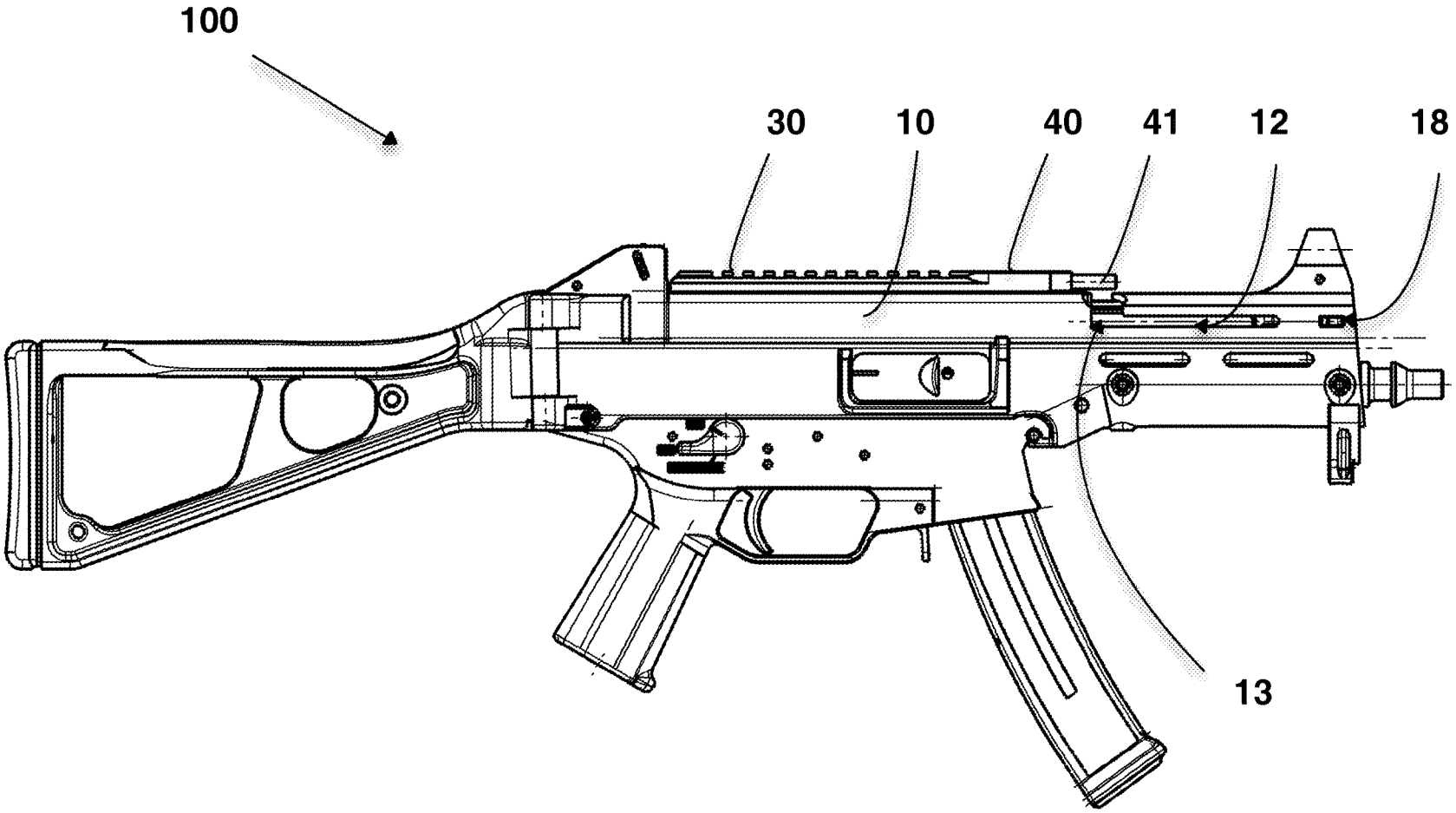
FIG. 19 shows a second side view of the entire weapon receiver, or self-loading firearm shown in FIG. 1.

FIGS. 16 to 19 show the receiver 10, or self-loading firearm 100, in full, wherein FIGS. 16 and 18 show it in a perspective from the left side and right side, and FIGS. 17 and 19 show a side view of the left and right sides of the self-loading firearm.

The loading lever 20, or handle 22, is in the first guide track, and locked in place in the front end position. The extended Picatinny rail 30 comprises the safety device 40 with a safety pin 41 in the first position. The loading lever 20, or handle 22, cannot be reversed in this position. The second recess 17 is located in an extension of the first guide track 11. The safety pin 41 extends over the opening 13 connecting the first guide track 11 to the second guide track 12 for this. The stock 60 is at the end opposite the muzzle 50. Reference is also made to the explanations regarding FIG. 1.

Figure 20:
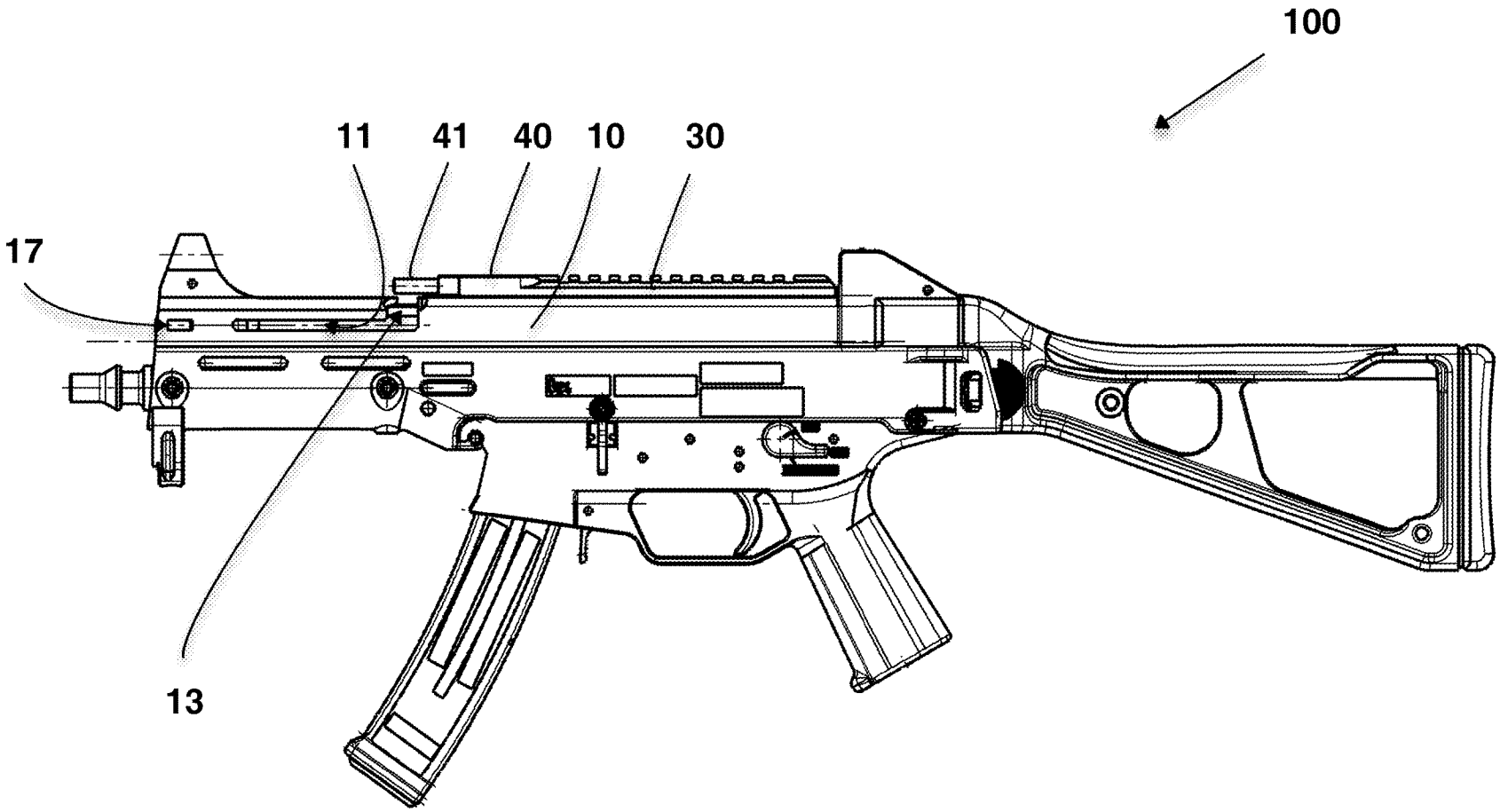
FIG. 20 shows the view shown in FIG. 17, without the loading lever.

Lastly, FIG. 20 shows the self-loading firearm 100, or receiver 10, shown in FIG. 17, but without the loading lever. It can be clearly seen that the first guide track 11 and second recess 17 are axially symmetrical and flush to one another. The same applies for the second guide track 12 and the third recess 18.

Further examples can be derived by the person skilled in the art from the following claims and attached drawings.

Certain loading mechanisms are known:

A loading lever is permanently coupled to the breechblock in the known G36 by the applicant, and in the known SA 80. Such a loading lever is also referred to as a rotating loading lever, because it moves along with the breechblock mount as it moves back and forth, as described above. If the loading lever protrudes away from the weapon, it could injure the shooter. If the protruding loading lever strikes an obstacle, this may obstruct loading. This permanent mounting on the breechblock is currently known for both military and civilian self-loading weapons.

Non-rotating loading levers are also known from the AR15 variants, such as the HK 416 and 417 by the same applicant. It is also known that the loading lever can be mounted on and removed from the loading device without tools.

Loading devices had already been developed prior to the first world war, in which the loading lever was decoupled from the breechblock after loading. Because of this decoupling, it was impossible to close the breech with the loading lever, if it did not close properly.

On the whole, various types of loading devices are known, which can also contain a loading lever located on either the right or left side of the weapon.

By way of example, a non-rotating tension slider, which is attached to one side and can be operated from one side, in particular for the MG4, is known from DE 101 22 345 C1 by the same applicant, by means of which the breechblock can be pretensioned against the pressure of a closing spring. There is an oblong slot in the receiver, which has a clamping rail in which the tension slider is guided and can be secured in place.

A loading device is also known from DE 10 2006 006 034 B3 by the same applicant, e.g. for the HK416, in which the loading lever can be operated from both sides, via two handles. Actuation of one handle automatically releases the second handle from a latch on the weapon, in order to carry out a loading process.

A loading device for self-loading pistols, in particular the known G36, is also known from EP 0 489 024 B1, which has a pivoting loading lever that can be locked in place. This is attached directly to the breechblock via an intermediate part, and can be pivoted out of the receiver to either side of the longitudinal axis of the breechblock.

Operating conditions, such as the ambient temperature, weapon temperature, contaminants, sustained firing, etc. are constantly changing with military weapons. As a result, in some cases, a cartridge may not be fully inserted into the chamber, or some other loading obstruction may arise. When loading is obstructed, the breech system may not close correctly without additional manipulation, thus endangering the shooter. Although these obstructions are extremely rare, as a matter of principle, a military weapon should be a free of obstructions as possible. With a proper loading device, the breech can often be operated manually, thus eliminating any loading obstructions.

A loading device that has a non-rotating loading lever is known from U.S. Pat. No. 7,798,045 B1, in which the loading lever has handles protruding from both the left and right sides. This cannot be dismantled or selectively operated on either the left or right side without tools. The loading device comprises a slide that engages in a corresponding recess on the breechblock, to slide it forward toward the chamber as a closure element.

Loading devices are known from U.S. Pat. Nos. 9,104,848 B2, 8,156,854 B2 and 8,561,517 B2, that cannot be mounted on the left or right sides without tools. The self-loading weapons disclosed therein comprise a receiver and a hand guard coupled thereto, wherein the loading device is guided in the hand guard. The loading lever can be pivoted between a standby position and an operating position, wherein it engages in a recess in the gas piston rod when in the operating position, both when reloading and in its function as a closing element. The loading device therefore does not act directly on the breechblock. In an alternative embodiment, the loading device has ambidextrous operating handles.

U.S. Pat. No. 8,307,747 B2 discloses another non-rotating loading device that has a loading slide with a spring-loaded latching lug that engages with the breechblock. The loading lever protrudes rigidly from the weapon. When functioning as a closing element, the latching lug engages in the breechblock and guides it forward. U.S. Pat. No. 8,539,871 B1 describes a similar loading device.

FR 1,349,766 and the parallel DE 1 208 221 disclose a loading device with a non-rotating loading slide, which can be coupled directly to the breechblock via a locking pin. The loading device is located on top of the weapon and comprises a spring-loaded central tensioning handle, which acts on a locking element, either by means of just a spring, via a threaded connection, or a pivotal handle, and moves it from the standby position into its operating position, in which the tension slide can be coupled directly to the breechblock. This loading device cannot be converted to right side or left side operation without tools.

DE 199 03 321 A1 and the parallel US 2002/0046642 A1 by the same applicant also disclose a loading lever assembly for a pistol. The loading lever can be moved to the left or right sides without tools, is mounted directly on the breechblock, and is therefore designed as a rotating element. The loading lever cannot be pivoted, and therefore protrudes laterally from the side of the weapon.

EP 0 207 058 B1 discloses a non-rotating loading device with a loading lever on one side, that cannot be converted, which can be pivoted laterally. The loading lever acts on the end of a longitudinal guide rod in the breech via a slide during the loading process. In its closing element function, the loading lever likewise engages with the longitudinal guide rod via the slide.

U.S. Pat. No. 3,686,998 discloses a pivotal loading lever that does not rotating during the loading process. A slide acts directly on the breechblock. When used as a closing element, the pivotal loading lever is locked in place on a breechblock extension via an oblong hole on its axis and a hook. It cannot be dismantled without tools.

Lastly, DE 10 2018 001 984 A1 discloses a loading device for a self-loading firearm that has a breechblock that can move longitudinally in the receiver. The loading device comprises a loading lever, which has a loading lever handle coupled to a loading lever retainer, and a loading lever housing that is guided longitudinally in the receiver. The loading lever handle can be pivoted from a standby position to an operating position and back in the loading lever retainer. Furthermore, the loading lever retainer can be mounted on and removed from the loading lever housing on either the left or right side without tools.

The disclosure provides several examples of alternative, structurally simple, and functionally reliable weapon receivers for self-loading firearms that improve upon known loading mechanisms. In particular, as described herein one object is to create a weapon receiver that enables a simple and functionally reliable loading of the firearm. It is also the object to provide a self-loading firearm that has such a receiver.

The examples herein are therefore based on a weapon receiver that has a first guide track in which a loading lever can be moved in order to move a loading tube that can be brought into or is in contact with the breechblock. The weapon receiver is characterized by a second track that is connected to the first track via a first opening in the receiver, within which the loading lever can be moved to move the loading tube, such that the loading lever can be operated ambidextrously. In one example, a self-loading firearm is equipped with such a weapon receiver.

By providing a second guide track connected to the first guide track via a first opening, the loading lever can advantageously be operated ambidextrously. The user only has to move the loading lever from the left to the right side, or the right to the left side, for this. Because it is possible to move the loading lever without converting it, and without tools, an ambidextrous loading device can be obtained with structurally simple means, which can be adapted to the ergonomics of the shooter and therefore to either a right-handed or left-handed shooter. The ambidextrous operation is currently frequently demanded by the public authorities.

The examples herein are also distinguished in that the movement of the loading lever back and forth between the first guide track and the second guide track can be carried out very quickly, because it can be done, as specified above, without any conversion or tools. This has the major advantage that the weapon can be passed back and forth between a left-handed user and a right-handed user, and the new shooter can quickly adapt a weapon originally not set up for him to his own needs. This time savings is of major advantage, in particular in combat.

The second guide track and the first opening also result in a weight reduction, such that a lighter receiver or lighter self-loading firearm can be obtained. The self-loading firearm can also be loaded with the safety on, resulting in further safety.

Changing the loading lever from the first guide track to the second guide track and back is referred to as reversing the loading lever. Reversing the loading lever can take place when the weapon is unloaded, partially loaded, or fully loaded. Reversing the loading lever can take place when the safety is either on or off.

The first and second guide tracks can form, in particular, a slot running in the longitudinal direction of the receiver, a so-called longitudinal slot. The loading lever can be moved longitudinally within the guide tracks between two end positions, specifically a front end position and a rear end position. The two guide tracks are ideally symmetrical.

The first opening can be an opening in the top of the receiver that connects the two guide tracks to one another. The first opening can connect, by way of example, the front regions of the first and second guide tracks to one another, in particular the regions where the loading lever assumes its front end position.

In one preferred example, however, the first opening connects the rear regions of the first and second guide tracks, in particular the regions where the loading lever assumes its rear end position. If this opening is located here, the reversing of the loading lever can advantageously be combined with the loading of the weapon such that both the loading and reversing can take place in a single movement. Placing the first opening in the rear also prevents unintentional reversal, because the user must consciously move the loading lever against the force of the closing spring to reverse it.

In a preferred example, the first and second guide tracks each have a recess in which the loading lever is locked in place, such that the loading lever can be locked in place on either the left or right side of the receiver. The respective recesses allow the loading lever to be locked in place in the rear position, such that it is possible to look into the chamber.

It is of particular advantage if the respective recesses are provided in the same opening that connects the first guide track to the second guide track. This makes it possible to reverse the loading lever quickly from the locked position thereof.

In a structurally simple design, the respective recesses extend toward the muzzle in the receiver, in particular with a semicircular extension. The semicircular extension can also be regarded as a U-shaped and/or V-shaped extension or shape. The selection of the geometry of the recess can also depend on the geometry of the loading lever.

It is preferred that the recesses are separated from one another by a portion of the weapon receiver, wherein this portion extends over the recesses toward the stock of the receiver. The risk of an unintentional reversal of the loading lever is reduced with such a receiver portion.

The extension of the first opening between the receiver portion and the part of the receiver opposite this portion must be greater than the part of the loading lever that passes through the first opening. For this, the ratio d of the extension d1 of the opening to the corresponding extension d2 of the loading lever is $d=d1/d2$, where $1<d<2.0$.

A good compromise between preventing an unintentional reversal and intentional reversal of the loading lever has proven to be in the range where $1.0<d<1.5$. A ratio of substantially 1.2 has proven to be particularly preferable in this context.

In a preferred example, there is a safety device with a safety element, which can be moved back and forth between a first position and a second position, wherein the safety element prevents reversal of the loading lever between the first and second guide tracks, and allows this reversal in the second position, and the safety device is configured to retain the safety element in at least the first position.

The safety device is intended to prevent an unintentional reversal of the loading lever. In differing from the ratio d described above, the safety device forms a mechanical lock or barrier that the user must activate prior to reversing the loading lever.

The safety device is at least configured such that a safety element is retained in the first position (i.e., that position in which the reversal is prevented). The safety device is also preferably configured such that the safety element is also retained in the second position (i.e., in the position in which the reversal is allowed). It is also conceivable, however, that the safety element must be retained in the second position manually by the user by means of an appropriate manipulation.

In a structurally simple example, the safety element is located on the weapon receiver or on a component connected to the weapon receiver. It is particularly preferred in this context that the safety element is located in or on a profile rail located on top of the receiver. The Picatinny rail is an example of such a profile rail. The Picatinny rail is a toothed rail according to NATO standards for quick, reproducible mounting of accessories on firearms. The safety device is particularly preferably received on the end surface of the profile rail, or a component connected to the end surface of the profile rail. This advantageously does not affect the mounting of initially vertical and subsequently horizontal accessories.

The safety element can form a safety pin, in particular, which has a circular or polygonal cross section.

In a structurally simple example, the safety element can be moved longitudinally and is spring loaded, and it can be moved from the first position to the second position counter to the spring force, and from the second position to the first position with the spring force. The longitudinal movement on the end surface of the profile rail has proven to be particularly advantageous. This configuration makes it easy to manipulate for both left- and right-handed shooters.

Alternatively, the safety element can be articulated, and pivoted over an axis between the first and second positions.

When the assembly can be moved longitudinally and is spring-loaded, it is preferred that the safety element comprises a gearing that interacts with the spring such that the safety element can be retained in the first position and in the second position without the effects of external forces. Such a mechanism is, in principle, similar to that for retractable ballpoint pens.

As such, the loading lever can be pushed inward by activating the safety element against the spring force in the longitudinal direction, until it latches in place in the second position in an audible and/or tactile manner. When the safety element is pushed again, or an unlocking mechanism is activated, it is released from the second position, and moved with the spring force into the first position.

In a preferred example, the weapon receiver has at least one counter-latch for locking a latching element on the loading lever in place, such that the loading lever can be locked in place in both the first guide track and in the second guide track while the breechblock is moved on the weapon receiver. The latching element and the loading lever preferably form an integral unit, wherein the latching element forms a latching lug in particular. Another recess or groove, etc. can be used as the counter-latch.

If the loading lever is secured in place on the receiver, then the loading tube mechanically coupled to the loading lever is likewise secured in place on the receiver. By securing the loading tube place, it is prevented from moving back and forth, and in particular from negatively affecting the closing function of the breechblock.

It is preferred that the at least one counter-latch is formed by a second and third opening in the receiver. This results in a structurally simple design. The second and third openings can be located in particularly axially between the muzzle and the respective guide tracks. It is particularly preferred that the first guide track and second opening, and the second guide track and third opening are substantially flush to one another in the axial direction.

"Substantially flush" means, for example, that the upper ends of the respective guide tracks and the upper end of the second or third opening are flush to one another (i.e., form a straight line in the longitudinal direction). In this context, "flush" can also mean, e.g., that just the lower ends of the respective guide tracks and the lower end of the second or third opening are flush to one another (i.e., form a straight line in the longitudinal direction). It is preferred that both the respective upper and lower ends of the guide tracks, and the second and third openings, form a straight line in the longitudinal direction.

Second and third openings extending basically toward the front can be particularly easily formed in terms of the production technology. Furthermore, the loading lever can have a substantially constant thickness, likewise resulting in a structurally simple loading lever.

A particularly secure latching of the latching element, in particular the latching lug, is obtained in that the second and third openings have a polygonal, in particular rectangular design. It is particularly beneficial with these second and third openings if the latching element, in particular the latching lug, has a polygonal geometry that corresponds to that of the second and third openings.

Another aspect of the examples is that there is a profile rail for the weapon receiver, or the self-loading firearm, which comprises the safety device with the safety element described above. Accordingly, a modified Picatinny rail is provided, in particular.

The profile rail has a safety device with a safety element on its end surface facing toward the muzzle, wherein the safety element can be moved back and forth between a first position and a second position, and the safety device is configured to retain the safety element in at least the first position. The safety element extends in the longitudinal direction of the profile rail, at least in the first position, in order to prevent an unintentional reversal of the loading lever.

Such a profile rail can be referred to as an "extended" Picatinny rail. The safety device is advantageously located at the end, such that it does not impair the mounting of accessories on the profile rail.

The safety element can be in the form of a pin, in particular, preferably with a cylindrical, polygonal, or oval cross section. The safety element can be elastic, or located on an elastically deformable element. A spring is one example of an elastically deformable element.

In a first example of the profile rail, the safety element can move longitudinally and is spring-loaded, and can be moved from the first position to the second position against the force of the spring, and from the second position to the first position with the force of the spring.

A profile rail is particularly preferred if the safety device comprises a mechanism, e.g. a gearing, that interacts with the spring, such that the safety element can be retained in the first and second positions without the effects of an external force. Such a mechanism is advantageous because the user is able to keep one hand free to reverse the loading lever, for example, while holding the self-loading firearm with the other hand. With the embodiment in which the safety element is only held in the first position by the safety device, the user must manually retain the safety element in the second position, e.g. at a handle attached to the safety element and passing through a lateral opening in the front part of the profile rail.

Alternatively to a safety pin that can move longitudinally, it is preferred if the safety element is articulated, and can be pivoted about an axis between the first and second positions.

Other embodiments are possible and are contemplated.

What is claimed is:

1. A receiver for a self-loading firearm, the receiver comprising:

a first guide track within which a loading lever can be moved to move a loading tube that can be brought into contact with, or is in contact with, a breechblock; and a second guide track connected to the first guide track, wherein the loading lever can be shifted to the second guide track via a first opening in the receiver to move the loading tube, such that the loading lever can be operated ambidextrously for loading the self-loading firearm.

2. A receiver for a self-loading firearm, the receiver comprising:

a first guide track within which a loading lever can be moved to move a loading tube that can be brought into contact with, or is in contact with a breechblock; and a second guide track connected to the first guide track, wherein the loading lever can be shifted to the second guide track via a first opening in the receiver to move the loading tube, such that the loading lever can be operated ambidextrously, wherein the first opening connects rear areas of the first and second guide track to one another.

3. The receiver according to claim 1, wherein the first and second guide tracks each include a recess for locking the loading lever in place, such that the loading lever can be locked in place on a left or a right side of the receiver.

4. A receiver for a self-loading firearm, the receiver comprising:

a first guide track within which a loading lever can be moved to move a loading tube that can be brought into contact with, or is in contact with a breechblock; and a second guide track connected to the first guide track, wherein the loading lever can be shifted to the second guide track via a first opening in the receiver to move the loading tube, such that the loading lever can be operated ambidextrously, wherein the first and second guide tracks each include a recess for locking the loading lever in place, such that the loading lever can be locked in place on a left or a right side of the receiver and wherein the recesses are formed in the first opening.

5. The receiver according to claim 3, wherein the recesses have extensions facing toward a muzzle of the receiver, and wherein the extensions are semicircular.

6. The receiver according to claim 3, wherein the recesses are separated from one another by a receiver portion of the receiver, wherein the receiver portion extends over both recesses toward a stock of the receiver.

7. A receiver for a self-loading firearm, the receiver comprising:

a first guide track within which a loading lever can be moved to move a loading tube that can be brought into contact with, or is in contact with a breechblock;

a second guide track connected to the first guide track, wherein the loading lever can be shifted to the second guide track via a first opening in the receiver to move the loading tube, such that the loading lever can be operated ambidextrously; and a safety device with a safety element, which can be moved back and forth between a first position and second position, wherein the safety element prevents movement of the loading lever between the first guide track and the second guide track when in the first position, and allows this movement when in the second position, and wherein the safety device is configured to retain the safety element in at least the first position.

8. The receiver according to claim 7, wherein the safety element is located on the receiver, or on a component connected to the receiver.

9. The receiver according to claim 7, wherein the safety element is located in or on a profile rail located on top of the receiver.

10. The receiver according to claim 7, wherein the safety element comprises a pin, which has a circular or polygonal cross section.

11. The receiver according to claim 7, wherein the safety element is movable longitudinally and is spring loaded and can be moved from the first position to the second position by pressing against a force of a spring, and can be moved from the second position to the first position with the force of the spring.

12. The receiver according to claim 7, wherein the safety element is articulated and can be pivoted back and forth about an axis between the first position and the second position.

13. The receiver according to claim 11, wherein the safety device comprises a gearing that interacts with the spring such that the safety element can be retained in the first position and the second position without an external force.

14. A receiver for a self-loading firearm, the receiver comprising:

a first guide track within which a loading lever can be moved to move a loading tube that can be brought into contact with, or is in contact with a breechblock;

a second guide track connected to the first guide track, wherein the loading lever can be shifted to the second guide track via a first opening in the receiver to move the loading tube, such that the loading lever can be operated ambidextrously; and at least one counter-latch in which a latching element on the loading lever can catch a latching lug such that the loading lever can be held in place in either the first guide track or the second guide track while the breech moves on a weapon housing.

15. The receiver according to claim 14, wherein at least one counter-latch is formed by a second opening and a third opening in the receiver.

16. The receiver according to claim 15, wherein the second and third openings are located axially between a muzzle and the guide tracks.

17. The receiver according to claim 16, wherein the first guide track, the second opening, the second guide track, and the third opening are substantially flush to one another in an axial direction.

18. The receiver according to claim 15, wherein the second and third openings are polygonal.

19. A self-loading firearm, comprising:

a loading lever a loading tube adjacent the loading lever;

a breechblock; and a receiver including:

a first guide track within which the loading lever can be moved to move the loading tube into contact with the breechblock; and a second guide track connected to the first guide track, wherein the loading lever can be shifted to the second guide track via a first opening in the receiver to move the loading tube, such that the loading lever can be operated ambidextrously for loading the self-loading firearm.

20. A self-loading firearm, comprising:

a loading lever;

a loading tube adjacent the loading lever;

a breechblock;

a receiver including:

a first guide track within which the loading lever can be moved to move the loading tube into contact with the breechblock;

a second guide track connected to the first guide track, wherein the loading lever can be shifted to the second guide track via a first opening in the receiver to move the loading tube, such that the loading lever can be operated ambidextrously; and a safety device with a safety element, which can be moved back and forth between a first position and second position, wherein the safety element prevents movement of the loading lever between the first guide track and the second guide track when in the first position, and allows this movement when in the second position, and wherein the safety device is configured to retain the safety element in at least the first position.

21. The self-loading firearm according to claim 20, wherein the safety element is located on the receiver, or on a component connected to the receiver.

22. The self-loading firearm according to claim 20, wherein the safety element is located in or on a profile rail located on top of the receiver.

23. The self-loading firearm according to claim 20, wherein the safety element comprises a pin, which has a circular or polygonal cross section.

24. The self-loading firearm according to claim 20, wherein the safety element is movable longitudinally and is spring loaded and can be moved from the first position to the second position by pressing against a force of a spring, and can be moved from the second position to the first position with the force of the spring.

25. The self-loading firearm according to claim 20, wherein the safety element is articulated and can be pivoted back and forth about an axis between the first position and the second position.

26. A profile rail for a weapon receiver of a self-loading firearm, the profile rail comprising:

a safety device with a safety element extending from an end surface of the safety device and facing toward a muzzle of the self-loading firearm, wherein the safety element can be moved back and forth between a first position and a second position, and wherein the safety device is configured to retain the safety element in at least the first position, wherein when in the first position the safety element prevents movement of a loading lever between a first guide track and a second guide track and wherein when in the second position the safety element prevents movement of the loading lever between the first guide track and the second guide.

27. The profile rail according to claim 26, wherein the safety element can move longitudinally and is spring loaded, and, can be moved from the first position to the second position by pressing against a force of the spring, and can be moved from the second position to the first position with a force of the spring.

28. A profile rail for a weapon receiver of a self-loading firearm, the profile rail comprising:

a safety device with a safety element extending from an end surface of the safety device and facing toward a muzzle of the self-loading firearm, wherein the safety element can be moved back and forth between a first position and a second position, and wherein the safety device is configured to retain the safety element in at least the first position, wherein the safety element is articulated and can be pivoted about an axis between the first position and the second position.

29. A profile rail for a weapon receiver of a self-loading firearm, the profile rail comprising:

a safety device with a safety element extending from an end surface of the safety device and facing toward a muzzle of the self-loading firearm, wherein the safety element can be moved back and forth between a first position and a second position, and wherein the safety device is configured to retain the safety element in at least the first position, wherein the safety element can move longitudinally and is spring loaded, and, can be moved from the first position to the second position by pressing against a force of a spring, and can be moved from the second position to the first position with a force of the spring, wherein the safety device comprises a gearing that interacts with the spring such that the safety element can be retained in the first position and the second position without an external force.

30. The profile rail according to claim 26, wherein the safety element comprises a pin, having a cylindrical, polygonal, or oval cross section.

31. A receiver for a self-loading firearm, the receiver comprising:

a first guide track on a first side of the receiver; and a second guide track on a second side of the receiver opposite the first side to the first guide track, wherein a first opening in the receiver connects the first guide track to the second guide track.

32. A receiver for a self-loading firearm, the receiver comprising:

a first guide track on a first side of the receiver;

a second guide track on a second side of the receiver opposite the first side to the first guide track, wherein a first opening in the receiver connects the first guide track to the second guide track; and a safety device with a safety element movable between a first position and second position, wherein in the first position the safety element covers the first opening in an axial direction.

33. The receiver according to claim 32, wherein the safety element is located on the receiver, or on a component connected to the receiver.

34. The receiver according to claim 32, wherein the safety element is located in or on a profile rail located on top of the receiver.

35. The receiver according to claim 32, wherein the safety element comprises a pin, which has a circular or polygonal cross section.

36. The receiver according to claim 32, wherein the safety element is movable longitudinally and is spring loaded and can be moved from the first position to a second position by pressing against a force of a spring, and can be moved from the second position to the first position with the force of the spring.

37. The receiver according to claim 32, wherein the safety element is articulated and can be pivoted back and forth about an axis between the first position and the second position.

38. The receiver according to claim 2, wherein the first opening connects rear regions of the first and second guide tracks.

39. The receiver according to claim 1, wherein the first and second guide tracks are symmetrical.

* * * * *